US011346051B2

(12) United States Patent
Luxenbourg et al.

(10) Patent No.: US 11,346,051 B2
(45) Date of Patent: May 31, 2022

(54) AROMATIZED AND FLAVORED PAPER PRODUCTS

(71) Applicant: IIW ENTOURAGE DELIVERY SYSTEMS Ltd., Herzlia (IL)

(72) Inventors: Gil Luxenbourg, Herzlia (IL); Raphael Luxenbourg, Herzlia (IL); Daniela Ilieva Batovska, Sofia (BG); Jualian Simeonov Karadjov, Sofia (BG)

(73) Assignee: IIW ENTOURAGE DELIVERY SYSTEMS Ltd., Herzlia (IL)

( * ) Notice: Subject to any disclaimer, the term of this patent is extended or adjusted under 35 U.S.C. 154(b) by 330 days.

(21) Appl. No.: 16/553,217

(22) Filed: Aug. 28, 2019

(65) Prior Publication Data

US 2019/0390408 A1 Dec. 26, 2019

Related U.S. Application Data

(63) Continuation-in-part of application No. PCT/IL2018/050234, filed on Mar. 1, 2018.

(60) Provisional application No. 62/725,350, filed on Aug. 31, 2018, provisional application No. 62/882,514, filed on Nov. 7, 2017, provisional application No. 62/466,127, filed on Mar. 2, 2017.

(51) Int. Cl.

| | |
|---|---|
| ***D21H 17/02*** | (2006.01) |
| ***D21H 27/08*** | (2006.01) |
| ***D21H 21/38*** | (2006.01) |
| ***A24D 1/02*** | (2006.01) |

(52) U.S. Cl.

CPC ..... *D21H 17/02* (2013.01); *A24D 1/02* (2013.01); *D21H 21/38* (2013.01); *D21H 27/08* (2013.01)

(58) Field of Classification Search

None

See application file for complete search history.

(56) References Cited

U.S. PATENT DOCUMENTS

| | | | |
|---|---|---|---|
| 2002/0074007 A1 | 6/2002 | Miyauchi et al. | |
| 2006/0130861 A1 | 6/2006 | Luan et al. | |
| 2008/0011312 A1 | 1/2008 | Matsufuji et al. | |
| 2013/0209753 A1 | 8/2013 | Idheileh | |
| 2015/0181925 A1 | 7/2015 | Turner | |
| 2016/0376263 A1 | 12/2016 | Patron et al. | |
| 2020/0108018 A1* | 4/2020 | Shadurin ..... | A24B 15/167 |

FOREIGN PATENT DOCUMENTS

| | | |
|---|---|---|
| EP | 2587949 | 5/2014 |
| WO | 03041521 | 5/2003 |
| WO | 2017196840 | 11/2017 |

OTHER PUBLICATIONS

Sameer H. Kareem et al, Porosity Measurements of Cellulose Acetate Filters for Some Brands of Cigarette Using Mercury Porosimeter, Mustansiriya J. Sci. 21, Jan. 2010, 57-66.

Bernhard Eitzinger et al, The pore size distribution of naturally porous cigarette papers and its relation to air permeability and diffusion capacity, Beiträge zur Tabakforschung International, vol. 26, No. 7, Sep. 1, 2015, pp. 312-319.

* cited by examiner

*Primary Examiner* — Dennis R Cordray

(74) *Attorney, Agent, or Firm* — The Roy Gross Law Firm, LLC; Roy Gross

(57) ABSTRACT

The present invention relates to paper products, inter alia, smoking paper products, stably enriched with aroma and/or flavor compounds. More particularly, the invention relates to paper products enriched with a terpene profile, mimicking flavor and/or aroma of a cannabis plant.

20 Claims, 8 Drawing Sheets

AROMATIZED AND FLAVORED PAPER PRODUCTS

RELATED APPLICATION/S

This application is a continuation in part of PCT/IL2018/050234 filed 1 Mar. 2018, which claims benefit of U.S. Provisional Patent Application No. 62/466,127 filed 2 Mar. 2017 and of U.S. Provisional Patent Application No. 62/582,514 filed 7 Nov. 2017.

This application claims the benefit of priority of U.S. Provisional Patent Application No. 62/725,350 filed 31 Aug. 2018.

The contents of the above applications are all incorporated by reference as if fully set forth herein in their entirety.

FIELD OF THE INVENTION

The present invention relates to paper products, inter alia, smoking paper products, stably enriched with aroma and/or flavor compounds. More particularly, the invention relates to paper products enriched with a terpene profile, mimicking flavor and/or aroma of a cannabis plant.

BACKGROUND

Terpenes are hydrocarbons occurring widely in plants and animals and built up from isoprene (i.e., $C_5H_8$) units. Terpenoids are regarded as modified terpenes, for example, when methyl groups are moved or removed, or when oxygen atoms added. The term "terpenes", in many occasions is used to broadly include terpenoids.

Terpenes are typically present in small amounts in living organisms, where they play numerous vital roles in plant physiology as well as important functions in cellular membranes.

Terpenes are naturally formed by the combination of two molecules of acetic acid to give mevalonic acid ($C_6H_{12}O_4$) and conversion of the latter to isopentenyl pyrophosphate, which contains the five-carbon isoprene skeleton. Additional transformations of the isopentenyl compound yield the various terpenes and terpenoids.

Terpenes are typically classified according to the number of isoprene units in the molecule. Monoterpenes ($C_{10}H_{16}$) contain two isoprene units, sesquiterpenes ($C_{15}H_{24}$) contain three, diterpenes ($C_{20}H_{32}$) contain four, triterpenes ($C_{30}H_{48}$) contain six, and tetraterpenes ($C_{40}H_{64}$) contain eight isoprene units. Polyterpenes (a.k.a. rubber and gutta-percha) contain 1,000-5,000 isoprene units, joined together to form a long chain. Monoterpenes, sesquiterpenes, and diterpenes are abundant in essential oils of plants.

Terpenes possess desirable properties for use in food, cosmetic, pharmaceutical and biotechnology industries.

The present invention pertains to a novel and advantageous use of those compounds in paper products.

SUMMARY OF THE INVENTION

Objects of the invention are achieved by providing a paper product, such as, a smoking rolling paper, stably enriched with aroma and/or flavor compounds.

Objects of the invention are achieved by providing a paper product, such as, a smoking rolling paper, stably enriched with aroma and/or flavor compounds and/or with cannabinoid compounds.

Objects of the invention are achieved by providing a rolling paper stably enriched with one or more terpene and/or terpenoid compounds.

Objects of the invention are achieved by providing a rolling paper, stably enriched with one or more cannabinoids and/or at least one or more terpene and/or terpenoid compounds.

Thus, an aspect of the invention pertains to a paper product infused with an effective amount of a composition comprising at least one of: a flavor compound, an aroma compound, and a cannabinoid compound.

In one or more embodiments, the aroma compound and/or flavor compound and/or cannabinoid compound originate from a plant, such as a cannabis plant. In one or more embodiments, the aroma compound and/or flavor compound is a terpene and/or a terpenoid. In one or more embodiments, the aroma compound and/or flavor compound is a synthetic compound.

In one or more embodiments, the paper products further comprise a fixative agent. In one or more embodiments, the fixative agent is a cannabinoid. In one or more embodiments, the fixative agent is a compound other than a cannabinoid. In one or more embodiments, the fixative agent is a combination of a cannabinoid and another fixative agent.

The present invention is based in part on the unexpected discovery that certain fixative agents that can bind the cellulose of the paper product and also terpenes and/or terpenoids, efficiently allow a stabilizing effect on terpenes and terpenoids within paper products, thereby reducing the evaporation of those molecules from papers products.

Thus, yet another aspect of the invention pertains to an aromatized and/or flavored paper product, the paper product comprising, at least one terpene and/or at least one terpenoid;

at least one of a fixative agent, wherein the fixative agent is characterized by binding capacity to cellulose, and biding capacity to terpene and/or terpenoid; and at least one antioxidant;

wherein the terpene and/or terpenoid is maintained in the paper product for a substantially longer time as compared to a paper product without a fixative agent and/or an antioxidant.

In one or more embodiments, the fixative agent imparts substantially increased stability of the terpenes and terpenoids in the paper products. In one or more embodiments, the fixative agent exhibits one or more features effective in stabilizing the terpenes and/or terpenoids in the papers. In one or more embodiments, the fixative agent is a cannabinoid which exhibits one or more features effective in stabilizing the terpenes and/or terpenoids in the papers. In one or more embodiments, the fixative agent does not include a compound other than a cannabinoid.

In one or more embodiments, the fixative agent is characterized by at least one of the features: odorless, flavorless, low volatility (e.g., with vapor pressure less than 0.1 mm Hg at 20° C.), easy penetration through the cellulose pores and binding capacity to cellulose, binding capacity to terpene(s) and/or terpenoid(s), essential oil and terpene solubility with Hansen Solubility Parameters (HSPs) between the cellulose and terpenes, reduction in the vapor pressure of the fragrances, preservation of lasting quality and end notes of fragrance mixtures, lack of toxicity, burning without producing any bad smelling/toxic/irritating products in the side stream smoke, and any combination thereof.

In one or more embodiments, the fixative agent contains oxygen atoms spaced or separated by 2 or more carbon atoms. In one or more embodiments, the fixative agent is having Hansen Solubility Parameters (HSPs) below the cellulose of the paper product. In one or more embodiments, the fixative agent is having Hansen Solubility Parameters (HSPs) above terpene(s) and terpenoid(s) applied onto the paper product. In one or more embodiments, the fixative agent is having Hansen Solubility Parameters (HSP) between the cellulose and terpene(s) and/or terpenoid(s) applied onto the papers. In one or more embodiments, the fixative agent is selected from the group consisting of: a polypropylene glycol, a PPG-20 methyl glucose ether, dipropylene glycol, polyethylene glycol PEG-400, an ester of citric acid (e.g., triethyl citrate, and acetyl triethyl citrate), a derivative thereof, and any combination thereof.

In one or more embodiments, the polypropylene glycol is a branched polypropylene glycol. In one or more embodiments, the branched polypropylene glycol is Glucam P-20, or a derivative thereof. In one or more embodiments, the fixative agent is a crystalline substance or oil able to dissolve in terpenes.

The fixative agent may, in some embodiments, be an antioxidant. For example, cannabinoids may act concomitantly as antioxidants and as pseudo-fixatives. Optionally, the fixative agent is a cannabinoid. Advantageously, cannabinoids also act as antioxidants and many of those molecules also possess active beneficial physiological effects. Further, the activity of cannabinoids can be modulated by terpenes and terpenoids, resulting in an entourage effect provided within smoking papers.

Hence, cannabinoids applied onto paper products, as herein disclosed, can allow a triple effect of stabilizing the binding of terpenes and terpenoids onto paper products, preventing oxidation of those molecules in the paper products, and allowing a modulated physiological effect elicited by the combination of the cannabinoids and terpenes and/or terpenoids.

In one or more embodiments, the fixative agent affords or mediates binding or incorporation of the flavor and/or aroma compound within the paper product.

In one or more embodiments, the paper products further comprise an antioxidant agent. In one or more embodiments, the antioxidant agent is a cannabinoid. In one or more embodiments, the antioxidant agent is a compound other than a cannabinoid. In one or more embodiments, the antioxidant agent is a combination of a cannabinoid and another antioxidant agent. In one or more embodiments, the antioxidant agent reduces or prevents oxidation of the terpenes and terpenoids, resulting with an enhanced stability of the aroma and/or flavor of the paper products.

In a further aspect, the present invention provides an aromatized and/or flavored paper product, the paper product comprising, one or more terpene(s) and/or one or more terpenoid(s), and at least one of a fixative agent and an antioxidant.

The amount and/or choice of antioxidant is of great importance in maintaining stability of the terpenes/terpenoids in the herein disclosed paper products. Essential oils, such as terpenes, and terpenoids are prone to oxidation, resulting in smell deterioration. The herein disclosed inventors successfully devised and prepared paper products with terpenes and/or terpenoids, wherein the terpenes and/or terpenoids stably maintained in the paper products. The inventors discovered that antioxidants presenting one or more features as defined below exhibited longer stability of the terpenes and/or terpenoids infused into the paper products. The antioxidants increased substantially the stability of terpenes and their mixtures by slowing down their decomposition by oxygen.

In one or more embodiments, the antioxidant exhibits one or more features effective in stabilizing the terpenes and/or terpenoids in the papers. In one or more embodiments, the antioxidant is a cannabinoid which exhibits one or more features effective in stabilizing the terpenes and/or terpenoids in the papers. In one or more embodiments, the features are selected from: oil solubility, chemical inertness or non-reactivity with compounds in the paper product, odorless, flavorless, low toxicity, not producing toxic and irritating substances during smoking or burning.

In one or more embodiments, the antioxidant is selected from a tocopherol (e.g., vitamin E, E306-E309), vitamin C (E300), a natural cannabinoid (e.g., a mono- and diphenols), and a synthetic antioxidant (e.g., butylated hydroxyanisole (BHA, E320), butylated hydroxytoluene (BHT, E321), propyl gallate (PG, E310), tert-butylhydroquinone (TBHQ, E319) and any combination thereof. In one or more embodiments, the antioxidant is one or more of a phenol selected from a cannabidiol, tetrahydrocannabinol, phenolic acids, flavonoids, gingerol, curcumin, vitamin E, butylated hydroxyanisole, a derivative thereof and a combination thereof.

In one or more embodiments, the terpene and/or terpenoid is maintained in the paper product for a substantially longer time as compared to a paper product without a fixative agent and an antioxidant or compared to a paper product with an antioxidant and without a fixative agent.

Thus, in a further aspect, the present invention provides aromatized and/or flavored paper product, the paper product comprising, one or more terpenes and/or terpenoids;

one or more of a fixative agent; and one or more of an antioxidant;

wherein the one or more of fixative agent chemically stabilizes the terpenes and/or terpenoids in the paper product, thereby maintaining the terpenes and/or terpenoids in the paper product for a longer time as compared to a paper product without a fixative agent and/or an antioxidant.

Thus, in yet a further aspect, the present invention provides aromatized and/or flavored paper product, the paper product comprising, one or more terpenes and/or terpenoids;

one or more of a fixative agent, wherein at least one of the fixative agent is a cannabinoid; and one or more of an antioxidant;

wherein the one or more of cannabinoids chemically stabilizes the terpenes and/or terpenoids in the paper product, thereby maintaining the terpenes and/or terpenoids in the paper product for a longer time as compared to a paper product without cannabinoids and antioxidants.

In one or more embodiments, the antioxidant is selected from the group consisting of: butylated hydroxyanisole, butylated hydroxytoluene, cannabidiol, propyl gallate, tertiary butylhydroquinone, tocopherol, vitamin E, and any combination thereof.

In one or more embodiments, the fixative agent is characterized by at least one of: oil solubility, binding capacity to cellulose, biding capacity to terpene and/or terpenoid, non-toxicity, flavorless, odorless, or any combination thereof.

In one or more embodiments, the fixative agent is selected from the group consisting of: a polypropylene glycol, a PPG-20 Methyl Glucose Ether, 1,3-butanediol, triethyl citrate, and any combination thereof. In one or more embodiments, the polypropylene glycol is having a M.W. of about 160 Da to about 10,000 Da. In one or more embodiments, the polypropylene glycol is having a M.W. selected from about 160 Da to about 400, and about 4,000 to about 10,000 Da.

Various cannabinoids are herein contemplated and applicable. In one or more embodiments, the cannabinoid is having Hansen Solubility Parameters (HSPs) below the cellulose of the paper product. In one or more embodiments, the cannabinoid is having Hansen Solubility Parameters (HSPs) above terpenes and terpenoids applied onto the paper product. In one or more embodiments, the cannabinoid is having Hansen Solubility Parameters (HSPs) between the cellulose and terpenes and/or terpenoids.

Various cannabinoids are contemplated, including without limitation, cannabidiol (CBD), $\Delta^9$-tetrahydrocannabinol (THC), cannabigerol (CBG), cannabinol (CBN), cannabichromene (CBC), cannabichromevarin (CBCV), cannabivarin (CBV), cannabidivarin (CBDV), tetrahydrocannabivarin (THCV), cannabigerovarin (CBGV), cannabicyclol (CBL), cannabielsoin (CBE), and any combination thereof. Various cannabinoid acids are contemplated including, without limitation, cannabidiolic acid (CBDA), $\Delta^9$-tetrahydrocannabinolic acid (THCA), cannabigerolic acid (CBGA), cannabichromenenic acid (CBCA), cannabichromevarinic acid (CBCVA), tetrahydrocanabivarinic acid (THCVA), cannabigerovarinic acid (CBGVA), cannabidivarinic acid (CBDVA), cannabicyclolic acid (CBLA), a derivative thereof, and a combination thereof.

Surprisingly and advantageously, the herein disclosed compositions and methods effectively produced paper products comprising relatively high levels of cannabinoids.

In some embodiments, the fixative agent weight per paper area is about 2.2 mg/cm$^2$. For example, the amount of the cannabinoid per each paper product is at least about 0.18 mg/cm$^2$. For example, at least about 0.2 mg/cm$^2$, at least about 0.25 mg/cm$^2$, at least about 0.3 mg/cm$^2$, at least about 0.4 mg/cm$^2$, or at least about 0.5 mg/cm$^2$. In one or more embodiments, the amount of the cannabinoid per each paper product is about 116 mg/g. For example, the amount of the cannabinoid per each paper product is at least about 15 mg, at least about 20 mg, at least about 30 mg, at least about 40 mg, at least about 50 mg, at least about 60 mg, at least about 70 mg, at least about 80 mg, or at least about 90 mg per gram paper. In one or more embodiments, the amount of the cannabinoid per each paper product is up to about 120 mg. For example, up to about 110 mg, 100 mg, 90 mg, 80 mg, 70 mg, 60 mg, 50 mg, 40 mg, 30 mg, or 20 mg. In one or more embodiments, the amount of the cannabinoid per each paper product is at least about 10 mg and up to about 120 mg. For example, at least about 15 mg and up to about 120 mg, at least about 20 mg and up to about 100 mg, or at least about 20 mg and up to about 80 mg.

Such high concentration of cannabinoids within smoking papers is novel and affords consumption of those products with a viable effective dose of the cannabinoids. The capability to infuse such high amounts of cannabinoids and terpenes and/or terpenoids within a paper allows controlling their concentration in those products and thereby devises and produces papers having cannabinoids as active ingredients with specified controlled doses.

In one or more embodiments, the cannabinoid binds both cellulose of the paper and the terpenes and/or terpenoids, thereby creating a chemical interaction that prolongs the retention time of the terpenes and/or terpenoids on the paper product.

In one or more embodiments, the terpene and/or the terpenoid is provided as a natural cannabis plant extract. In one or more embodiments, the terpene and/or the terpenoid is an isolated terpene and/or the terpenoid. In one or more embodiments, the terpene and/or the terpenoid is a synthetic compound.

In one or more embodiments, the herein disclosed paper products include selected terpenes/terpenoids profile produced from purified terpenes/terpenoids combined together to create a new profile of those molecules, that may or may not contain an amount of plant extract.

In one or more embodiments, the paper product is a smoking paper product. In one or more embodiments, the smoking paper product is selected from a rolling paper, a tip and a filter.

In one or more embodiments, the paper is porous presenting pores having a diameter of about $1\times10^{-3}$ μm to about $2\times10^{-3}$ μm.

In one or more embodiments, the paper product is manufactured by applying onto the paper a composition comprising one or more terpene(s) and/or one or more terpenoid(s), and at least one of a fixative agent and an antioxidant.

In one or more embodiments, the one or more terpene(s) and/or one or more terpenoid(s) is present within the composition in an amount of about 45% to about 55%, by weight of the composition. For example, the one or more terpene(s) and/or one or more terpenoid(s) is present within the composition in an amount of about 20% to about 60%, by weight of the composition. For example, the one or more terpene(s) and/or one or more terpenoid(s) is present within the composition in an amount of about 15% to about 70%, by weight of the composition.

In one or more embodiments, the antioxidant is present within the composition in an amount of about 0.1% to about 2% by weight of the composition. For example, the antioxidant is present within the composition in an amount of about 0.5% to about 2.5% by weight of the composition. For example, the antioxidant is present within the composition in an amount of about 0.1% to about 3% by weight of the composition.

In one or more embodiments, the fixative agent is present within the composition in an amount of about 45% to about 55% by weight of the composition. For example, the fixative agent is present within the composition in an amount of about 40% to about 75% by weight of the composition. For example, the fixative agent is present within the composition in an amount of about 20% to about 80% by weight of the composition.

In one or more embodiments, the composition comprises:

one or more terpene(s) and/or one or more terpenoid(s) in an amount of at least about 20% by weight of the composition; and one or more of a fixative agent in an amount of at least about 5% by weight of the composition.

In one or more embodiments, the composition comprises:

one or more terpene(s) and/or one or more terpenoid(s) in an amount of at least about 20% by weight of the composition; and one or more of a fixative agent in an amount of at least about 20% by weight of the composition.

In one or more embodiments, the composition comprises:

one or more terpene(s) and/or one or more terpenoid(s) in an amount of at least about 20% by weight of the composition;

one or more of a cannabinoid in an amount of at least about 5% by weight of the composition; and one or more of a fixative agent other than cannabinoid in an amount of at least about 20% by weight of the composition.

In one or more embodiments, the weight ratio between the fixative agent and the terpene and/or terpenoid is about 3:1 to about 1:3. For example, the weight ratio between the fixative agent and the terpene and/or terpenoid is about 4:1 to about 1:4. In one or more embodiments, the ratio is about 1:1.

In one or more embodiments, evaporation of the terpene and/or terpenoid is substantially reduced as compared to a paper product without a fixative agent and an antioxidant, or as compared to a paper product with an antioxidant and without a fixative agent. In one or more embodiments, the overall amount of the terpene and/or terpenoid remains within the paper for at least about 10 minutes following exposure of the paper to the environment.

In one or more embodiments, the paper product comprises a terpene and/or terpenoid profile presenting substantial similarity to the terpene and/or terpenoid profile present naturally within a cannabis strain. In one or more embodiments, the paper product comprises a cannabinoid profile presenting substantial similarity to the terpene and/or terpenoid profile present naturally within a cannabis strain.

In one or more embodiments, the profile is stably maintained for at least about 10 minutes at ambient environment. In one or more embodiments, at least about 50% of the terpenes/terpenoids molecules remain in the paper product, following 5 minutes or even 10 minutes exposure to ambient air. In one or more embodiments, more than 70% of the terpenoids and terpenes are maintained in the paper products following 10 minutes exposure to the environment.

In one or more embodiments, the paper further comprises a cellulose coat provided on top of said paper product.

In one or more embodiments, the paper product is manufactured by applying pressure onto the paper following applying the terpenes/terpenoids composition.

In one or more embodiments, the pressure is about 100 g/sq inch to about 5000 g/sq. In one or more embodiments, the pressure is at least about 16 g/cm$^2$. In one or more embodiments, the pressure is about 16 g/cm$^2$ to about 775 g/cm$^2$.

In one or more embodiments, the terpene(s) and/or terpenoid(s) is present in the paper product in an amount of about 0.2 mg/cm$^2$ to about 1 mg/cm$^2$.

In one or more embodiments, the fixative agent is present in the paper product in an amount of about 0.2 mg/cm$^2$ to about 1 mg/cm$^2$.

In yet a further aspect, the present invention provides a method of producing an aromatized and/or flavored paper product, the method comprising:

preparing a composition comprising one or more terpene(s) and/or one or more terpenoid(s);

applying the composition onto the paper product; and applying pressure onto the paper product, thereby manufacturing an aromatized and/or flavored paper product.

In yet a further aspect, the present invention provides a method of producing an aromatized and/or flavored paper product, the method comprising preparing a composition comprising one or more terpene(s) and/or one or more terpenoid(s);

applying the composition onto the paper product;

applying pressure onto the paper product; and removing excess of the composition from the paper product; thereby manufacturing an aromatized and/or flavored paper product.

In one or more embodiments, the composition further comprises at least one of a fixative agent and an antioxidant.

In one or more embodiments, the method further comprises applying a cellulose layer over said paper product. In one or more embodiment, the step of applying the composition onto the paper product occurs concomitantly to applying pressure onto the paper product.

In one or more embodiments, the method further comprises packing the paper product within a hermetically sealed package.

In one or more embodiments, applying pressure is conducted using a roller. In one or more embodiments, the pressure is at least about 16 g/cm$^2$. In one or more embodiments, the pressure is within the range of about 16 g/cm$^2$ to about 775 g/cm$^2$.

In one or more embodiments, the paper product is a smoking paper product. In one or more embodiments, the smoking paper product is selected from a rolling paper, a tip and a filter. In one or more embodiments, the smoking paper product is a rolling paper and wherein applying the composition onto the paper product is conducted on both sides of the rolling paper.

Yet a further aspect of the invention pertains to a method of producing the herein disclosed aroma and/or flavor compound-enriched paper product, the method comprising:

preparing a composition comprising predetermined amounts of an aroma and/or a flavor compound;

applying a predetermined amount of the composition on one side of the paper;

spreading the composition onto the paper product; and inserting the composition within the paper product.

In one or more embodiments, the methods comprise applying an amount of the composition on the other side of the paper, and spreading the composition on top of the paper, optionally with a fibrous pad or a roller.

In one or more embodiments, inserting the composition within the paper is made by physical means, such as by pressure, to thereby press and insert the composition into the pores of the paper.

In one or more embodiments, the method further comprises packing the terpene/terpenoid enriched paper.

In one or more embodiments, the method further comprises sealing the package.

Unless otherwise defined, all technical or/and scientific terms used herein have the same meaning as commonly understood by one of ordinary skill in the art to which the invention pertains. Although methods and materials similar or equivalent to those described herein can be used in the practice or testing of embodiments of the invention, exemplary methods or/and materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION OF THE INVENTION

Figure 1:
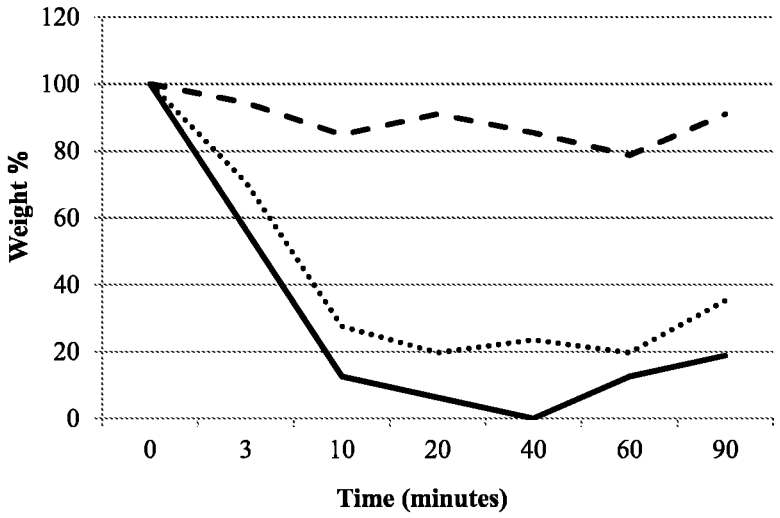
FIG. 1 is a line graph showing the average weight percent differences between rolling papers incorporated with a composition comprising terpenes, a fixative agent and an antioxidative agent (a striped line), rolling papers incorporated with a composition comprising terpenes in a comparable amount but without a fixative agent and an anti-oxidative agent (a dotted line), and rolling papers incorporated with a composition comprising terpenes in half the amount (a full line); according to some embodiments of the invention.

It is understood that the invention is not limited to the particular methodology, protocols, and reagents, etc., described herein, as these may vary as the skilled artisan will recognize. It is also to be understood that the terminology used herein is used for the purpose of describing particular embodiments only and is not intended to limit the scope of the invention. The following exemplary embodiments may be described in the context of paper products stably enriched with terpenes and terpenoids for ease of description and understanding. However, the invention is not limited to the specifically described products, compositions, devices and methods, and may be adapted to various applications without departing from the overall scope of the invention. All ranges disclosed herein include the endpoints. The use of the term "or" shall be construed to mean "and/or" unless the specific context indicates otherwise.

The present invention provides novel smoking products comprising flavor and/or aroma compounds. The present invention is particularly useful for smoking products and provides, for example, rolling papers that are flavored and/or aromatized with a flavor and/or aroma compound.

Terpenes and terpenoids are known in their relatively high volatile characteristics. Accordingly, in typical cases, terpenes or terpenoids will rapidly evaporate to air when applied onto paper products. The present invention overcomes this obstacle by adding an agent (hereinafter referred to as "a fixative agent") that affords stability and enhances retention of the terpene/terpenoid within the paper product.

Advantageously, the aroma and/or flavor compounds are substantially stably maintained within the product, even following exposure to the environment or while smoking (i.e., upon burning the paper).

Further advantageously, the herein disclosed products provide an improved smell, and/or flavor and/or increase the smoking experience effect.

Further advantageously, the paper products are optionally incorporated with terpene and/or terpenoid profile which is substantially similar (in the types of molecules and/or the ratio between the molecules) to terpene and/or terpenoid profile present naturally in a cannabis plant. Such similar terpene/terpenoid profile mimics the flavor and/or aroma of natural cannabis plant.

The invention is based in part on the unexpected discovery that, compositions, that comprise, in addition to terpenes and terpenoids, a fixative agent and/or an antioxidant agent, and/or that were infused with terpenes and terpenoids while applying pressure, present an improved retention and/or stability of the terpenes and/or terpenoids within the paper.

In one or more embodiments, the invention is based on the unexpected discovery that, compositions, that comprise, in addition to terpenes and terpenoids, a cannabinoid which acts as a fixative agent and/or an antioxidant agent present an improved retention and/or stability of the terpenes and/or terpenoids within the paper.

As exemplified herein below, cannabidiol (CBD) and terpenoids applied onto paper products remained on the paper products even following 10 minutes of exposure to open environment. Without being bound by any theory or mechanism of action, the CBD stabilizes the terpenes and terpenoids and inhibits their immediate evaporation by mediating a chemical interaction with the cellulose of the paper products. It is hypothesized that the CBD binds cellulose and also terpenes and terpenoids, thereby creating a chemical interaction that prolongs the retention time of the terpenes and terpenoids on paper products, such as hydrogen bonding, electrostatic interactions, and van der Waals dispersion forces. Cannabidiol (CBD) is known as an antioxidant agent comparable to BHT and tocopherol and therefore can additionally act as such when applied onto the paper products.

In one or more embodiments, the herein disclosed products provide a modulated smoking experience effect due to the combination of active compounds, i.e., terpenes and/or terpenoids and cannabinoids.

Cannabinoids represent a group of C19 or C21 terpenophenolic compounds found in *Cannabis sativa* L. Geranyl pyrophosphate is a parent compound to both phytocannabinoids and terpenoids. After coupling with either olivetolic acid or divarinic acid, pentyl or propyl cannabinoid acids are produced, respectively, via enzymes that accept either substrate, a manifestation of Mechoulam's postulated 'Nature's Law of Stinginess'. Although having important biochemical properties, acidic forms of phytocannabinoids are most commonly decarboxylated via heat to produce the more familiar neutral phytocannabinoids. Cannabinoids bind to human cannabinoid receptors CB-1 and CB-2, thus causing a range of physiological effects in, for example, the nervous system, the immune and bone cells. According to the WHO, the physiological effects of cannabinoids are facilitated by terpenes/terpenoids through the so called "entourage effect" or synergism between the cannabinoids and terpene/terpenoids.

Hence, the herein disclosed invention provides paper products which may also afford physiological effects facilitated by the combination of cannabinoids and terpenes and/or terpenoids on the papers. The cannabinoids are further effective in stabilizing the terpenes and/or terpenoids, preventing oxidation and stabilizing those molecules within the papers.

As used herein the term "terpene and/or terpenoid profile" refers to an assembly of at least two types of terpene and/or terpenoid molecules being substantially similar to the types of terpene and/or terpenoid molecules present naturally in a cannabis plant.

In an embodiment of the invention, the term refers to several types of terpene and/or terpenoid molecules in the profile. For example, 3 or more, 4 or more, 5 or more, or 10 or more, or 15 or more, or 20 or more terpene and/or terpenoid molecules. In an embodiment of the invention, the term relates to the ratio between terpenes and/or terpenoids molecules (i.e., molar or weight ratio). In an embodiment of the invention, the ratio between molecules in the terpene and/or terpenoid profile is substantially similar to the ratio between terpene and/or terpenoid molecules present naturally in a cannabis plant.

As used herein the term "stability" refers to terpenes and/or terpenoids maintained substantially stable in the paper product. In an embodiment of the invention, the herein disclosed paper products present significantly higher stability of the terpenes and/or terpenoids for longer time periods as compared to comparable paper products without an antioxidant and/or a fixative agent, and/or that weren't infused with the terpenes and/or terpenoids while applying pressure.

In an embodiment of the invention, the terpenes/terpenoids exhibit substantial stability for at least about 3 minutes, 5 minutes, at least about 10 minutes or at least about 15 minutes, at least about 20 minutes, at least about 30 minutes, or any value in between. Each possibility presents a separate embodiment of the invention. In an embodiment of the invention, the terpenes/terpenoids exhibit stability for at least about 5 minutes, and up to about 90 minutes. For example, at least about 5 minutes and up to about 80 minutes, or at least about 10 minutes and up to about 70 minutes, or at least about 10 minutes and up to about 60 minutes, at least about 5 minutes and up to about 50 minutes, or at least about 5 minutes and up to about 40 minutes, or at least about 5 minutes and up to about 30 minutes, or any time periods in between. Each possibility presents a separate embodiment of the invention.

In an embodiment of the invention, at least about 50% of the terpenes/terpenoids molecule types (irrespective of the overall terpenes/terpenoids quantity), and/or overall quantity remain in the paper product, following exposure to ambient air, for at least about 3 minutes, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, or about 90 minutes, or any value in between. Each possibility presents a separate embodiment of the invention. For example, at least about 55%, 60%, 65%, 70%, 75%, 80%, 85%, 90%, or 95% of the terpenes/terpenoids remain in the paper product, following exposure to ambient air, for at least about 3 minutes, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, or about 90 minutes. Each possibility presents a separate embodiment of the invention.

Without being bound by any theory or mechanism of action, the enhanced stability is due to the addition of a fixating agent and/or antioxidant and/or due to applying pressure when manufacturing the paper product. In accordance with this embodiment, the term "comparable paper product" refers to a paper product comprising similar amounts of aroma and/or flavor compounds and without a fixating agent and/or without an antioxidant and/or, that wasn't manufactured while applying pressure on the paper following spreading the terpene/terpenoid composition.

In one or more embodiments, the herein disclosed products present enhanced maintenance/retention of the aroma and/or flavor compounds in the paper which is significantly higher than a corresponding product containing a similar amount of flavor and/or aroma compounds but does not contain an antioxidant and/or a fixating agent.

In one or more embodiments, the term "significantly higher" encompasses at least about 1.2, 1.5 folds, or at least 2 folds more. Each possibility presents a separate embodiment of the invention.

As used herein the term "retention" refers to the overall amount of aroma and/or flavor compounds that remains in the paper product as compared to comparable paper product without an antioxidant and/or a fixative agent, and/or that wasn't infused with terpene and/or terpenoid while applying pressure. In an embodiment of the invention, retention refers to the entire terpene/terpenoid molecules maintained for longer period in a paper product (i.e., presents a reduced evaporation) as compared to a comparable paper without an antioxidant and/or a fixative agent, and/or that wasn't infused with terpene and/or terpenoid while applying pressure.

In an embodiment of the invention, the terpenes/terpenoids exhibits substantial enhanced retention for at least about 5 minutes, at least about 10 minutes, at least about 15 minutes, at least about 20 minutes, at least about 25 minutes, or at least about 30 minutes, or at least about 40 minutes, or at least about 50 minutes, or at least about 60 minutes, or any value in between.

In an embodiment of the invention, the overall quantity of the terpenes/terpenoids exhibits retention of at least about 20% for 90 minutes or above at ambient air. For example, at least about 50%, or 60%, or 70%, or 80% of the overall terpenes/terpenoids is still infused following about 5 minutes or above, or 10 minutes or above exposure to ambient air. In an embodiment of the invention, at least about 50% of the overall terpenes/terpenoids is still infused following about 5, 10 or 20 minutes or above, or at least about 40% of the overall terpenes/terpenoids is still infused following about 20, or 30 minutes or above, or at least about 15% of overall terpenes/terpenoids is still infused following about 60 minutes or above, or at least about 10% of the overall terpenes/terpenoids is still infused following about 90 minutes or above, exposure to ambient air.

In an embodiment of the invention, the term "substantially" is interchangeable with the term "statistically substantially".

As used herein the term "paper products" encompasses various types of products made of paper. The paper product may present various colors and sizes. In one or more embodiments, the paper product is a smoking paper product. As used herein the term "smoking product" encompasses any optional product used for smoking and made of paper. In an embodiment of the invention, the smoking product is made of a paper for which the addition of an aroma and/flavor compound may be applicable. In an embodiment of the invention, the paper product is a smoking product. In an embodiment of the invention, the paper product includes cellulose. Suitable smoking products include, without limitation, a rolling paper, a tip, and a filter (e.g., a straw filter).

Any smoking rolling papers, filters and tips are contemplated. Exemplary filters include those filters used in pipes or hookahs. In one or more embodiments, the term includes sanitary and/or toiletries paper products, such as wet wipes, wiping papers, paper hand towels, tissues, toilet paper, and pads. In one or more embodiments, the term does not include sanitary and/or toiletries paper products, such as toilet paper and pads.

In one or more embodiments, the paper product has a thickness of at least about 15 μm. For example, the thickness may be no more than about 35 μm, 30 μm, 25 μm or 20 μm, or within the range of about 15 μm to about 35 μm, between about 15 μm to about 30 μm, or between about 18 μm to about 22 μm, or between about 20 μm to about 22 μm, or any value in between. Each possibility presents a separate embodiment of the invention.

In one or more embodiments, the paper product has a grammage (i.e., mass per unit of area) of at least about 10 $g/m^2$. For example, the grammage may be no more than about 20 $g/m^2$, 18 $g/m^2$, 17 $g/m^2$, 16 $g/m^2$ or 15 $g/m^2$, or within the range of about 10 $g/m^2$ to about 20 $g/m^2$, between about 10 $g/m^2$ to about 16 $g/m^2$, or between about 11 $g/m^2$ to 15 $g/m^2$, or any value in between. Each possibility presents a separate embodiment of the invention.

In one or more embodiments, the paper product has a density of at least about 350 $kg/m^3$. For example, at least about 400 $kg/m^3$, or at least about 500 $kg/m^3$, or at least about 600 $kg/m^3$, or at least about 650, or any value in between. Each possibility presents a separate embodiment of the invention. For example, the density may be no more than about 750 $kg/m^3$, 700 $kg/m^3$, 680 $kg/m^3$, or 670 $kg/m^3$, or within the range of about 400 $kg/m^3$ to about 700 $kg/m^3$, between about 630 $kg/m^3$ to about 670 $kg/m^3$, between 649 $kg/m^3$ and 651 $kg/m^3$, or any value in between. Each possibility presents a separate embodiment of the invention.

In an exemplary embodiment, the smoking paper may be porous, presenting pores with a diameter in the range of between about $1\times10^{-3}$ μm to about $2\times10^{-3}$ μm. For example, about $1.4\times10^{-3}$ μm to about $1.6\times10^{-3}$ μm, or about 0.54 to about 2.54 μm.

In an exemplary embodiment, the smoking paper may have porosity (herein referred to as percentage of the bulk volume of air) in the range of between about 50% to about 70%. For example, about 50% to about 65%, or about 54% to about 58%, or about 55.6% to about 57.6%.

In an exemplary embodiment, the smoking paper may have smoothness (according to Bekk method) in the range of between about 10 s to about 20 s. For example, about 13 to about 20 Bekk seconds, or about 15 to 17 Bekk seconds.

In an exemplary embodiment, the paper product is a rolling paper having a size of between 5 cm (width) and 11 cm (length).

As used herein the term "aroma compound" encompasses any compound that may add an aroma or odor to paper products. The aroma compound should be suitable such that it can be incorporated within a paper.

As used herein the term "flavor compound" encompasses any compound that may add flavor or taste to paper products. The flavor compound should be suitable such that it can be incorporated within a paper.

In one or more embodiment, the aroma and/or flavor compound is purified from a plant (e.g., from a plant extract). In one or more embodiment, the aroma and/or flavor compound is provided within a plant extract. In one or more embodiment, the aroma and/or flavor compound is a synthetic compound. In one or more embodiment, the aroma and/or flavor compound is a terpene. In one or more embodiment, the aroma and/or flavor compound is a terpenoid.

In yet a further aspect of the invention, there is provided a composition comprising at least one terpene and/or terpenoid. The composition may further comprise a fixative agent. The composition may further comprise an antioxidant agent.

As used herein the term "terpenes" encompasses a large and diverse class of organic compounds, produced by a variety of plants or animals. Terpenes confer a strong odor. Terpenes are also major constituents of cannabis plants (such as *Cannabis sativa*), which contain at least 120 identified compounds. The difference between terpenes and terpenoids is that terpenes are hydrocarbons, whereas terpenoids are considered as modified terpenes that contain additional functional groups, or in which methyl groups have been moved or removed, or oxygen atoms added. For example, myrcene (a hydrocarbon) is a terpene, and linalool (an alcohol) is a terpenoid. Terpenoids are also known as isoprenoids. Cannabis essential oils contain mostly mono- and sesquiterpenes/terpenoids. Monoterpenes (e.g. limonene) contain 10 carbon atoms, and sesquiterpenes (e.g. caryophyllene) contain 15 carbon atoms.

"Major terpenes/terpenoids" are referred to herein as those compounds present in *Cannabis sativa* L strain in relatively high concentration. Depending on the cannabis strain, their amount usually varies from a few percent to about 50% of the total weight of the cannabis essential oil.

"Minor terpenes/terpenoids" are referred to herein as those compounds present in *Cannabis sativa* L strain in relatively low concentration. Their amount in cannabis essential oils may vary from below detection limit, to fractions of a percent, to (seldom) a few weight percent in some strains.

In an embodiment of the invention, the present invention is not limited in scope to the particular type of terpene/terpenoid. In one embodiment, the terpenes/terpenoids is Generally Regarded As Safe (GRAS), i.e., an FDA designation that a chemical or substance added to food is considered safe. In one or more embodiment, the terpene/terpenoid is regarded as a cannabis essential oil. In one or more embodiments, the terpene/terpenoid is other than those terpenes/terpenoids known to exhibit toxicity.

In one or more embodiments, the terpene/terpenoid is selected from a monoterpene, a bicyclic terpene, a sesquiterpene, a diterpene, a triterpene, a tetraterpene, or from a terpene alcohol, terpene aldehyde or terpene ketone.

In one or more embodiments, the terpene/terpenoid is selected from the group consisting of (+) fenchol, fenchol, (E)-β-caryophyllene, β-caryophyllene, (E)-epoxy-ocimene, epoxy-ocimene, (E)-nerolidol, nerolidol, 1-epi-cubenol, 7-epi-sesquithujene, 1,8-cineole, allo-aromadendrene, aromadendrene, bicyclogermacrene, bisabolene, borneol, camphene, camphor, caryophyllene oxide, cis-ocimene, coahuilensol, curcumene, delta-3-carene, endo-fenchol, elemene, geraniol, germacrene, guaiene, guaiol, gurjunene, humulene epoxide II, ipsdienol, isoborneol, limonene, d-limonene, dipentene, linalool, menthol, muurolene, myrcene, nerol, p-cymen-8-ol, p-cymene, sabinene, sabinene hydrate, selina-3,7(11)-diene, selinene, sesquicineole, sesquiphellandrene, sesquithujene, spathulenol, terpinen-4-ol, terpinene, terpinolene, thujene, trans-caryophyllene, trans-ocimene, viridiflorol, ylangene, α-bergamotene, α-bisabolol, α-cadinene, cadinene, α-pinene, β-pinene, α-cedrene, α-eudesmol, eudesmol, α-humulene, humulene, α-longipinene, α-phelladerene, phellandrene, pinene, α-pinene, α-terpinene, α-terpineol, α-terpinolene, β-caryophyllene, β-eudesmol, β-farnesene, β-phellandrene, β-pinene, β-selinene, and Δ3-carene, or a derivative thereof, and any combination thereof.

In one or more embodiments, the terpene/terpenoid is a major terpene/terpenoid. In one or more embodiments, the major terpene/terpenoid is selected from the group consisting of: (E)-caryophyllene, limonene, linalool, myrcene, trans-caryophyllene, α-humulene, α-pinene, β-caryophyllene, β-pinene, and any combination thereof. In one or more embodiments, the terpene/terpenoid is a minor terpene/terpenoid. In one or more embodiments, the minor terpene/terpenoid is selected from the group consisting of: fenchol, epoxy-ocimene, nerolidol, 1-epi-cubenol, 7-epi-sesquithujene, 1,8-cineole, allo-aromadendrene, aromadendrene, bicyclogermacrene, bisabolene, borneol, camphene, camphor, caryophyllene oxide, cis-ocimene, ocimene, coahuilensol, curcumene, delta-3-carene, endo-fenchol, elemene, geraniol, germacrene, guaiene, guaiol, gurjunene, humulene epoxide II, ipsdienol, isoborneol, menthol, muurolene, nerol, p-cymen-8-ol, p-cymene, sabinene, sabinene hydrate, selina-3,7(11)-diene, selinene, sesquicineole, sesquiphellandrene, sesquithujene, spathulenol, terpinen-4-ol, terpinene, terpinolene, thujene, ocimene, viridiflorol, ylangene, α-bergamotene, α-bisabolol, cadinene, cedrene, eudesmol, α-longipinene, α-phellandrene, α-terpinene, α-terpineol, α-terpinolene, β-farnesene, and β-phellandrene, a derivative thereof, and any combination thereof.

In one or more embodiments, the terpene/terpenoid is selected from the group consisting of: linalool, terpinolene, humulene, γ-terpinene, D-limonene, α-pinene, myrcene, β-caryophyllene, a derivative thereof, and any combination thereof.

In one or more embodiment, the terpene and/or terpenoid is purified from a cannabis plant. In one or more embodiment, the terpene and/or terpenoid is a synthetic compound. In one or more embodiment, the aroma and/or flavor compound is a derivative or a homologue of a terpene or a terpenoid, or a compound mimicking terpene or terpenoid. In one or more embodiment, the terpene/terpenoid is in an isolated form. In one or more embodiment, the terpene/terpenoid is isolated from a cannabis plant or from any other plant or animal.

As used herein, the term "isolated" refers to the terpene and/or terpenoid which is separated from at least some of the components with which it is usually associated in nature or in in vitro conditions, and/or prepared or purified by a process that involves the hand of a man.

In one or more embodiment, the terpene/terpenoid is substantially free of any natural or synthetic compounds. In one or more embodiment, the terpene/terpenoid is essentially free of any natural or synthetic compounds. In one or more embodiment, the terpene/terpenoid is free of any natural or synthetic compounds.

As used here, the term "substantially free" refers to a compound or composition comprising less than about 0.5%, or less than about 0.4%, or less than about 0.3%, or less than about 0.2%, or less than about 0.1%, or any percentage in between of a particular compound.

As used herein, the term "essentially free" refers to a compound or composition comprising less than about 0.05%, or less than about 0.04%, or less than about 0.03%, or less than about 0.02%, or less than about 0.01%, or less than about 0.005%, or any percentage in between, or having only trace amounts of a particular compound or of other compounds.

As used herein the purified or isolated terpene and/or terpenoid, refers to the compound being substantially or essentially pure of any other naturally occurring or non-naturally occurring substances, including cannabinoids that occur naturally in cannabis plants. In this context "substantially pure" can be taken to mean that no substantial amounts of cannabinoids other than terpenes and/or terpenoids are detectable by HPLC. According to some embodiments, the purified terpene and/or terpenoid comprises up to about 1% of non-terpene or terpenoid compound.

In one or more embodiments, the herein disclosed paper products are produced by application of a composition comprising terpenes and/or terpenoids. In one or more embodiments, the herein disclosed terpenes and/or terpenoids composition or rolling paper comprising same includes a mixture of pure and synthetic terpene and/or terpenoid compounds.

In one or more embodiments, the herein disclosed terpene/terpenoid composition or rolling paper comprising same includes a mixture of pure and synthetic terpene and/or terpenoid compounds. In one or more embodiments, the herein disclosed terpene/terpenoid composition or rolling paper comprising same includes a profile of terpenes and/or terpenoids compounds that is substantially similar to a cannabis plant.

In some embodiments, the terpene(s) and/or terpenoid(s) is present in the terpene and/or terpenoid composition at about 15% to about 70% by weight of the composition. In some embodiments, the terpene(s) and/or terpenoid(s) is present in the terpene and/or terpenoid composition at about 20% to about 65%, at about 20% to about 60%, or at about 40% to about 60%, or at about 45% to about 55% by weight. For example, the terpene(s) and/or terpenoid(s) is present at about 49% to about 51% by weight. In some embodiments, the herein disclosed terpene(s) and/or terpenoid(s) composition comprises at least about 15%, at least about 20%, at least about 25%, at least about 30%, at least about 35%, at least about 40%, or at least about 45% of terpenes and/or terpenoids. Each possibility represents a separate embodiment of the invention.

In one or more embodiments, one terpene/terpenoid may reach up to about 59% of the terpene and/or terpenoid composition. For example, one terpene/terpenoid may be present in an amount of between 10% and 59%. In one or more embodiments, a combination of two terpenes and/or terpenoids may reach up to 50% of the composition. For example, two terpenes and/or terpenoids may be present in an amount of between 20% and 50%. In one or more embodiments, a combination of three terpenes and/or terpenoids may reach up to 50% of the composition. For example, three terpenes and/or terpenoids may be present in an amount of between 30% and 50%. In one or more embodiments, a combination of four and more terpenes and/or terpenoids may reach up to 50% of the composition. For example, four terpenes and/or terpenoids may be present in an amount of between 40% and 50%.

In some embodiments, the terpene(s) and/or terpenoid(s) weight per paper area is below about 1 $mg/cm^2$. In some embodiments, the terpene(s) and/or terpenoid(s) weight per paper area is at least about 0.2 $mg/cm^2$, at least about 0.4 $mg/cm^2$, or at least about 0.5 $mg/cm^2$. For example, the terpene(s) and/or terpenoid(s) weight per paper area is within the range of about 0.2 $mg/cm^2$ to about 0.8 $mg/cm^2$, or about 0.2 $mg/cm^2$ to about 0.7 $mg/cm^2$, or about 0.2 $mg/cm^2$ to about 0.5 $mg/cm^2$. In an exemplary embodiment, the terpene(s) and/or terpenoid(s) weight per paper area is about 0.37 $mg/cm^2$.

In one or more embodiments, the aroma and/or flavor compound presents a chemical profile or composition that is substantially similar to the chemical composition of those compounds present naturally within a cannabis plant. Said similarity can be of a full profile or a partial profile consisting of at least two terpenes and/or at least two terpenoids. In an exemplary embodiment, when a combination of at least two terpenes and/or at least two terpenoids is provided, the weight or molar ratio between the at least two terpenes and/or the at least two terpenoids is substantially similar to the actual ratio between those compounds present in the natural cannabis plant.

In one or more embodiments, the smoking product of the invention includes at least one terpene or terpenoid. For example, the smoking product includes a mixture (or a profile) comprising at least 2 terpenes, or at least 3, 4, 6, 8, 10, 12, 14, 16, 18, 20, 22, 24, 26, 28 or 30 of terpenes, or any value in between. The smoking paper product may include even higher amounts of terpenes or terpenoids. For example, more than 40, 60, 80, 100, 150, 200, 250 or above. Each possibility presents a separate embodiment of the invention.

In one or more embodiments, the smoking product of the invention includes at least one terpenoid. For example, the smoking product includes a mixture (of a profile) comprising at least 2 of terpenoids, or at least 4, 6, 8, 10, 12, 14, 16, 18, 20, 22, 24, 26, 28 or 30 of terpenoids. Each possibility presents a separate embodiment of the invention.

In one or more embodiments, the aroma and/or flavor compound(s) is incorporated within the paper, infused within the paper, bound within the paper, and/or coated onto the paper.

In one or more embodiments, the herein disclosed composition or products comprising same further contain a cannabinoid as a fixating agent (interchangeable with the term "fixative agent").

In one or more embodiments, the herein disclosed composition or products comprising same further contain a fixating agent (interchangeable with the term "fixative agent").

In one or more embodiments, the herein disclosed composition or products comprising same further contain a fixating agent other than a cannabinoid.

Terpenes and terpenoids are known in their relatively high volatile characteristics. Accordingly, in typical cases, providing paper products with terpenes or terpenoids will result in fast evaporation of the terpenes/terpenoids from the paper. The present invention overcomes this obstacle by adding an agent (hereinafter referred to as "a fixative agent") that affords stability and enhances retention of the terpene/terpenoid within the paper product. Further advantageously, the terpenes and/or terpenoids are maintained within the paper even in an opened environment (i.e., ambient air) and even when the product is being smoked.

The "fixative agent" may be any agent capable of incorporating and/or binding and/or maintaining, and/or stabilizing, and/or enhance retention, and/or reduce evaporation of the flavor and/or aroma compound within the paper. In one or more embodiments, the fixative agent is capable of binding to oils. In one or more embodiments, the fixative agent is soluble in oil (i.e., it is oil soluble). In one or more embodiments, the fixative agent is not water soluble, or in other words is water insoluble. In one or more embodiments, the fixative agent is amphiphilic. In one or more embodiments, the fixative agent is low volatile with vapor pressure less than 0.1 mm Hg at 20° C. In one or more embodiments, the fixative agent is hydrophobic. In one or more embodiments, the fixative agent is miscible with the terpene profile. In one or more embodiments, the fixative agent is capable of binding to cellulose without dissolving its components (Hansen parameters δP and δH below 19.9 $MPa^{1/2}$ and 22.5 $MPa^{1/2}$, resp.). In one or more embodiments, the fixative agent is odorless and safe for use in smoking products.

In the manufacture of fragrances, fixatives are used as substances capable to impart increased stability to the scent molecules and to slow the evaporation of those scent components such that the scent character during evaporation remains substantially constant. The substances typically used as fixatives are mostly low volatile, having high-boiling temperature and may themselves be scented or unscented.

As used herein the term "oil soluble" refers to a compound which is soluble in nonpolar substances, such as ether, chloroform, and oils. Oil-soluble compounds are often insoluble in water.

In one or more embodiments, the fixative agent is capable of binding to volatile oils. In one or more embodiments, the fixative agent is capable of binding to aroma oil, or essential oil. In one or more embodiments, the fixative agent is dissolved in aroma oil, or essential oil. In one or more embodiments, the fixative agent is capable of binding to a terpene and/or terpenoid.

The fixative may thus have binding affinity to terpene and/or terpenoid. The fixative agent may bind to a terpene and/or terpenoid via a chemical bond selected from an ionic bond, a polar bond, a covalent bond, and/or a hydrogen bond. In one or more embodiments, the fixative agent may bind to a terpene and/or terpenoid via a polar bond, or a hydrogen bond.

The fixative agent may bind to a terpene and/or terpenoid via intramolecular hydrogen bonding and van der Waals dispersion forces.

In one or more embodiments, the fixative agent is capable of binding (to a paper, or to one or more substances within a paper (e.g., cellulose). The fixative agent may thus have binding affinity to cellulose. The fixative agent may bind to cellulose via a chemical bond such as via an ionic bond, via a polar bond, via a covalent bond, and/or via a hydrogen bond. The fixative agent may bind to cellulose via intramolecular hydrogen bonding, van der Waals forces, and electrostatic interactions. Each possibility presents a separate embodiment of the invention. For example, it can interact with terpene and/or terpenoid via van der Waals forces. In one or more embodiments, the fixative agent is capable of binding concomitantly to a terpene and/or terpenoid and to cellulose.

In one or more embodiments, the fixative agent is a fragrance fixative. In one or more embodiments, the fixative agent is not a fragrance fixative. As used herein "fragrance fixatives" are liquid or waxy, natural or synthetic compounds with low to no volatility that can dissolve or be dissolved in fragrant compounds (e.g., terpenes/terpenoids). The fixative agent is used herein and is capable of substantially reducing the evaporation of one or more terpene/terpenoid from the paper product. In an embodiment of the invention, the fixatives are non-toxic or possess a very low toxicity and, when burned, produce low/insignificant amounts of irritating/toxic/obnoxious decomposition products. In an embodiment of the invention, the fixatives have a very weak to no smell. In an embodiment of the invention, the fixatives do not affect substantially the smell of the terpene composition.

In one or more embodiments, the fixative is flavorless. In one or more embodiments, the fixative is odorless. In an embodiment of the invention, the fixative agent is a cannabinoid or a derivative thereof. In an embodiment of the invention, the cannabinoid is selected from cannabidiol (CBD), $\Delta^9$-tetrahydrocannabinol (THC), cannabigerol (CBG), cannabinol (CBN), cannabichromene (CBC), cannabichromevarin (CBCV), cannabivarin (CBV), cannabidivarin (CBDV), tetrahydrocannabivarin (THCV), cannabigerovarin (CBGV), cannabicyclol (CBL), cannabielsoin (CBE), and any combination thereof. Various cannabinoid acids are contemplated including, without limitation, cannabidiolic acid (CBDA), $\Delta^9$-tetrahydrocannabinolic acid (THCA), cannabigerolic acid (CBGA), cannabichromenenic acid (CBCA), cannabichromevarinic acid (CBCVA), tetrahydrocanabivarinic acid (THCVA), cannabigerovarinic acid (CBGVA), cannabidivarinic acid (CBDVA), cannabicyclolic acid (CBLA), a derivative thereof, and a combination thereof.

In an embodiment of the invention, the fixative agent is cannabidiol (CBD). In an embodiment of the invention, the fixative agent is a polymer (e.g., a polypropylene glycol-based polymer). For example, the polypropylene glycol is having a M.W. (Molecular Weight) of 160 Dalton to 10000 Dalton.

In an exemplary embodiment, the molecular weight should be within the ranges of 160-400 Da, or of 4000 to 10,000 Da. Such compounds with these molecular weights have the lowest toxicity. In one exemplary embodiment, the fixative agent is PPG-20 methyl glucose ether (a.k.a, Glucam P-20). In a further exemplary embodiment, the fixative is 1,3-butanedeiol. In a further exemplary embodiment, the fixative is triethyl citrate. In a further exemplary embodiment, the fixative agent is dipropylene glycol. In a further exemplary embodiment, the fixative agent is PEG-400.

In some embodiments, the fixative agent is present in the terpene/terpenoid composition at about 30% to about 70% by weight. In some embodiments, the fixative agent is present in the terpene/terpenoid composition at about 30% to about 80% by weight. For example, the fixative agent is present in the terpene/terpenoid composition at about 40% to about 75%, 40% to about 70%, or at about 45% to about 60%, or at about 45% to about 55%, or at about 49% to about 51% by weight. In one or more embodiments, the terpene/terpenoid composition includes at least about 40%, at least about 50%, at least about 60%, or at least about 65% of a fixative agent.

In some embodiments, the fixative agent is a cannabinoid (e.g., cannabidiol) and is present in the terpene/terpenoid composition at about 1% to about 80% by weight. For example, the cannabinoid is present in the terpene/terpenoid composition at about 1% to about 75%, 1% to about 70%, or at about 1% to about 60%, or at about 1% to about 55%, or at about 1% to about 50% by weight. In one or more embodiments, the terpene/terpenoid composition includes at least about 1%, at least about 2%, at least about 3%, at least about 5%, at least about 10%, at least about 20%, or at least about 30% of a cannabinoid.

In one or more embodiments, the weight ratio between the fixative agent and the terpene and/or terpenoid is about 5:1 to about 1:5, or about 4:1 to about 1:4, or about 3:1 to about 1:3, or about 1:1.

In one or more embodiments, the weight ratio between the fixative agent and the terpene and/or terpenoid is 1:1 to 1:5, or 1:1 to 1:4, or about 1:1 to about 1:3, or about 1:1.

Optionally, a combination of fixative agents is included in the terpene/terpenoid composition. For example, a combination of a cannabinoid and another fixative agent is applicable and contemplated.

In some embodiments, the fixative agent weight per paper area is below about 1 mg/cm$^2$. In some embodiments, the fixative agent weight per paper area is at least about 0.2 mg/cm$^2$, 0.4 mg/cm$^2$, or 0.5 mg/cm$^2$, or 1 mg/cm$^2$. For example, the fixative agent weight per paper area is within the range of about 0.2 mg/cm$^2$ to about 0.8 mg/cm$^2$, or about 0.2 mg/cm$^2$ to about 0.7 mg/cm$^2$, or about 0.2 mg/cm$^2$ to about 0.5 mg/cm$^2$. In an exemplary embodiment, the fixative agent weight per paper area is about 0.37 mg/cm$^2$. In one or more embodiments, the fixative agent is Glucam P-20 or a derivative thereof. In one or more embodiments, the fixative agent is cannabidiol or a derivative thereof.

In one or more embodiments, the fixative agent does not dissolve or solubilize the main paper compound cellulose. Accordingly, the fixative agent may possess $\delta P$ and $\delta H$ below the $\delta P$ and $\delta H$ of cellulose. A fixative agent may further possess $\delta P$ and $\delta H$ above the $\delta P$ and $\delta H$ of terpenes and terpenoids applied onto the paper product, in order to allow solubilizing the terpenes and terpenoids. The fixative agent may possess $\delta D$ below the $\delta D$ of cellulose. Thus, in one or more embodiments, the fixative agent/cannabinoid has $\delta P$ value of below about 19.9 MPa$^{1/2}$. For example, the fixative agent/cannabinoid possesses a $\delta P$ value of below 19, or below 18, or below 17 MPa$^{1/2}$. For example, depending on the terpenes/terpenoids used, the fixative agent/cannabinoid possesses a $\delta P$ value of above about 1, or above 2, or above 3, or above 4, or above 5 and below 19.9 MPa$^{1/2}$. Thus, in one or more embodiments, the fixative agent/cannabinoid has $\delta H$ value of below about 22.5 MPa$^{1/2}$. For example, the fixative agent/cannabinoid possesses a $\delta H$ value of below 22, or below 21, or below 20 MPa$^{1/2}$. For example, depending on the terpenes/terpenoids used, the fixative agent/cannabinoid possesses a $\delta H$ value of above 2, or above 3, or above 4, or above 5, or above 6, or above 7 and below about 22.5 MPa$^{1/2}$. Thus, in one or more embodiments, the fixative agent/cannabinoid has $\delta D$ value of below about 24.3 MPa$^{1/2}$. For example, the fixative agent/cannabinoid possesses a $\delta H$ value of below 23, or below 21, or below 20 MPa$^{1/2}$. For example, depending on the terpenes/terpenoids used, the fixative agent/cannabinoid possesses a $\delta D$ value of above 2, or above 3, or above 4, or above 5, or above 6, or above 7 and below about 24.3 MPa$^{1/2}$.

In an exemplary embodiment, the paper product comprises a cannabinoid and a mixture of terpenes and/or terpenoids in a ratio of between about 4:1 to about 1:4, or between about 3:1 to about 1:3. For example, between about 2:1 to about 1:2, or about 1:1.

In an exemplary embodiment, the paper product comprises a cannabidiol and a mixture of the following terpenes in a ratio of 1:1: α-pinene, camphene, β-pinene, myrcene, pseudolimonene, limonene, α-terpinolene, 1,2-epoxylinalool, linalool, camphor, 3-allyl-2-methoxyphenol, α-cubebene, clovene, α-copaene, β-cis-caryophyllene, β-trans-caryophyllene, humulene-(v1), humulene, β-cadinene, β-selinene, α-selinene, L-calamenene, caryophyllene oxide, and cembrene.

In some embodiments, the terpene/terpenoid composition or paper product comprising same further comprise an antioxidant. The antioxidant prevents oxidation of the terpenes and terpenoids, allowing an enhanced stability and/retention of the paper product. The antioxidant in the presently described compositions and/or products can include any known acceptable compound that functions by inhibiting oxidation.

As used herein, the term "antioxidant agent" refers to compounds being either natural or synthetic that possess the capacity to slow down or prevent the oxidation/decomposition of an extremely wide range of products (e.g., foods, fragrances to plastics). Some antioxidants are better soluble in water; other antioxidants are better soluble in oils. In an exemplary embodiment of the invention, the antioxidant is oil soluble. In one or more embodiments, the antioxidant dissolves in the herein disclosed composition of terpene/terpenoid.

In one or more embodiments, the antioxidant is not water soluble, or in other words is water insoluble. Alternatively, or additionally, the antioxidant is amphiphilic. In one or more embodiments, the antioxidant is capable of binding to volatile oils. In one or more embodiments, the antioxidant is capable of binding to aroma oil, or essential oil. In one or more embodiments, the antioxidant is capable of binding to a terpene and/or terpenoid. The antioxidant may thus have binding affinity to terpene and/or terpenoid. The antioxidant may bind to a terpene and/or terpenoid via a chemical bond such as via an ionic bond, via a polar bond, a covalent bond, and/or a hydrogen bond. For example, it can interact with terpene and/or terpenoid via van der Waals forces. In one or more embodiments, the antioxidant is a fragrance antioxidant. In one or more embodiments, the antioxidant is capable of binding to a paper, or to one or more substances within a paper. (e.g., cellulose). The antioxidant may thus have binding affinity to cellulose.

As used herein "fragrance antioxidant" can dissolve fragrant compounds (e.g., terpenes/terpenoids). The antioxidant is used herein and is capable of substantially preventing oxidation of one or more terpene/terpenoid, thereby contributing in enhancing the stability and/or retention of the terpenes and terpenoids in the paper product. In an embodiment of the invention, the antioxidant is non-toxic or possesses a very low toxicity and, when burned, produces low/insignificant amounts of irritating/toxic/obnoxious decomposition products. In an embodiment of the invention, the antioxidant has a very weak to no smell. In an embodiment of the invention, the antioxidant does not affect substantially the smell of the terpene and/or terpenoid composition. In one or more embodiments, the antioxidant is flavorless. In one or more embodiments, the antioxidant is odorless.

In an embodiment of the invention, the antioxidant is selected from butylated hydroxyanisole (BHA, E320), butylated hydroxytoluene (BHT, E321), cannabinoid, cannabidiol (CBD), propyl gallate (PG, E310), tertiary butylhydroquinone (TBHQ, E319), tocopherols (e.g., vitamin E, E306-E309), vitamin C (E300), a derivative thereof and any combination thereof.

In an embodiment of the invention, the antioxidant is selected from cannabidiol (CBD), tetrahydrocannabinol (THC), cannabigerol (CBG), cannabinol (CBN), cannabichromene (CBC), cannabichromevarin (CBCV), cannabivarin (CBV), cannabidivarin (CBDV), tetrahydrocannabivarin (THCV), cannabigerovarin (CBGV), cannabicyclol (CBL), cannabielsoin (CBE), and any combination thereof. Various cannabinoid acids are contemplated including, without limitation, cannabidiolic acid (CBDA), $\Delta^9$-tetrahydrocannabinolic acid (THCA), cannabigerolic acid (CBGA), cannabichromenenic acid (CBCA), cannabichromevarinic acid (CBCVA), tetrahydrocanabivarinic acid (THCVA), cannabigerovarinic acid (CBGVA), cannabidivarinic acid (CBDVA), cannabicyclolic acid (CBLA), a derivative thereof, and a combination thereof.

The antioxidant may be used in various concentrations and the optimal concentration depends on the type of the antioxidant used. The choice of antioxidant, its concentration, or the use of mixes of more than one antioxidant should comply with the respective regulations. For example, BHA is used to preserve essential oils in concentrations of up to 0.5%. Natural cannabidiol is as good as synthetic BHT and can be used in concentrations of less than 0.5%.

In some embodiments, the antioxidant is present in the terpene/terpenoid composition at about 0.1% to about 5% by weight. For example, the antioxidant is present at about 0.1% to about 2%, or at about 0.5% to about 2% by weight. In some embodiments, the antioxidant is present at about 0.9% to about 1%, or at about 0.93% to about 0.95% by weight of the terpene/terpenoid composition.

In an exemplary embodiment of the invention, the antioxidant is tocopherol or a derivative thereof. In a further embodiment of the invention, the antioxidant is vitamin E, or a derivative thereof.

In some embodiments, the amount of vitamin E in a paper product is less than about 0.5 mg. In some embodiments, vitamin E is present in the composition at about 0.5% to about 2.5% by weight of the composition. For example, vitamin E is present at about 0.5% to about 2% by weight, or at about 0.75% to about 1.5%. In some embodiments, vitamin E is present at about 1% by weight.

In some embodiments, antioxidant weight per paper area is below about 0.1 mg/cm$^2$, or below about 0.01 mg/cm$^2$. For example, the antioxidant weight per paper area is about $7\times10^{-3}$ mg/cm$^2$ In some embodiments, a terpene/terpenoid composition provided herein is substantially antioxidant free. In some embodiments, a terpene/terpenoid composition provided herein is essentially antioxidant free. In some embodiments, a terpene/terpenoid composition provided herein is antioxidant free.

In some embodiments, a terpene/terpenoid composition provided herein is substantially water free. In some embodiments, a terpene/terpenoid composition provided herein is essentially water free. In some embodiments, a terpene/terpenoid composition provided herein is water free.

In some embodiments, a terpene/terpenoid composition provided herein is substantially wax free. In some embodiments, a terpene/terpenoid composition provided herein is essentially wax free. In some embodiments, a terpene/terpenoid composition provided herein is wax free.

In some embodiments, a terpene/terpenoid composition provided herein is substantially free of solids. In some embodiments, a terpene/terpenoid composition provided herein is essentially free of solids. In some embodiments, a terpene/terpenoid composition provided herein is solids free.

In some embodiments, a terpene/terpenoid composition provided herein is substantially free of an alcohol. In some embodiments, a terpene/terpenoid composition provided herein is essentially free of an alcohol. In some embodiments, a terpene/terpenoid composition provided herein is alcohol free.

In some embodiments, a terpene/terpenoid composition provided herein is substantially free of ethylene-vinyl acetate copolymer. In some embodiments, a terpene/terpenoid composition provided herein is essentially free of ethylene-vinyl acetate copolymer. In some embodiments, a terpene/terpenoid composition provided herein is ethylene-vinyl acetate copolymer free.

As used here, the term "substantially free" refers to a compound or composition comprising less than about 0.5%, or less than about 0.4%, or less than about 0.3%, or less than about 0.2%, or less than about 0.1%, or any percentage in between of a particular compound.

As used herein, the term "essentially free" refers to a compound or composition comprising less than about 0.05%, or less than about 0.04%, or less than about 0.03%, or less than about 0.02%, or less than about 0.01%, or less than about 0.005%, or any percentage in between, or having only trace amounts of a particular compound or of other compounds.

The invention overcomes the obstacle associated with evaporation of many flavor and/or aroma compounds by incorporation of one or more fixative agent and/or one or more antioxidant agent, and/or by applying pressure when manufacturing the paper product.

In one or more embodiments, the herein disclosed paper product does not include aroma and/or favor compound other than terpene and/or terpenoid. In one or more embodiments, the herein disclosed paper product consists of at least one compound selected from the list of: terpene(s), terpenoid(s), fixative agent(s), and antioxidant(s).

As used herein, the phrase "effective amount" describes an amount of the aroma and/or flavor compound that is sufficient to provide an added aroma and/or flavor to the paper product. As herein disclosed, an exemplary terpene/terpenoid composition for application to paper products may include:

about 20% or above by weigh of the composition of a terpene and/or terpenoid;

about 20% or above by weigh of the composition of a fixative agent; and about 1% or above by weigh of the composition of an antioxidant.

A further exemplary terpene/terpenoid composition for application to paper products may include:

about 40% or above by weigh of the composition of a terpene profile (e.g., 17% γ-terpinene, 17% terpinolene, 5% β-cis-ocimene, 1% D-limonene, 1% β-trans-caryophyllene, 1% 1,8-cineole, 1% β-trans-ocimene);

about 40% or above of a fixative agent (e.g., Glucam P-20); and about 1% of an antioxidant (e.g., vitamin E acetate).

A further exemplary terpene/terpenoid composition for application to paper products may include:

about 40% or above by weigh of the composition of a terpene profile (e.g., 20% β-trans-caryophyllene, 10% humulene, 9% D-limonene, 5% linalool);

about 40% or above of a fixative agent (e.g., Glucam P-20); and about 1% of an antioxidant (e.g., vitamin E acetate).

A further exemplary terpene/terpenoid composition for application to paper products may include:

about 40% or above by weigh of the composition of a terpene profile (20% terpinolene, 7.0% β-trans-caryophyllene, 5% D-limonene, 5% β-trans-ocimene, 3% myrcene, 2% β-pinene, 1% γ-terpinene, 1% α-pinene);

about 40% or above of a fixative agent (e.g., Glucam P-20); and about 1% of an antioxidant (e.g., vitamin E acetate).

A further exemplary terpene/terpenoid composition for application to paper products may include:

about 20% or above by weigh of the composition of a terpene and/or terpenoid profile; and about 20% or above by weigh of the composition of a cannabinoid (e.g., CBD).

A further exemplary terpene/terpenoid composition for application to paper products may include:

about 40% or above by weigh of the composition of a terpene and/or terpenoid profile (e.g., 18% γ-terpinene, 18% terpinolene, 5% β-cis-ocimene, 2% D-limonene, 2% β-trans-ocimene, 2% β-trans-caryophyllene, 1% 1,8-cineole); and about 40% or above by weigh of the composition of a cannabinoid (e.g., CBD).

A further exemplary terpene/terpenoid composition for application to paper products may include:

about 60% or above by weigh of the composition of a terpene and/or terpenoid profile (e.g., 31% β-trans-caryophyllene, 15% humulene, 14% D-limonene, 8% linalool, 1% caryophyllene oxide, 1% β-pinene, 1% α-terpineol); and up to about 40% by weigh of the composition of a cannabinoid (e.g., CBD).

A further exemplary terpene/terpenoid composition for application to paper products may include:

about 15% or above by weigh of the composition of a terpene and/or terpenoid profile (e.g., 11% terpinolene, 4% β-trans-caryophyllene, 2% D-limonene, 2% β-trans-ocimene, 1% myrcene, 1% β-pinene);

about 3% or above by weigh of the composition of a cannabinoid (e.g., CBD); and about 20% or above by weigh of the composition of a fixative agent other than a cannabinoid (e.g., PEG-400).

In a further aspect, the present invention provides a method of manufacturing an aromatized and/or flavored paper product. The herein disclosed paper products are prepared using the step of preparing a composition comprising certain amounts of an aroma and/or a flavor compound.

Optionally, the composition includes at least one antioxidant and/or at least one fixative agent. Optionally, an amount of the overall compounds in the composition over the paper is between about 0.4 mg/cm$^2$ to about 2 mg/cm$^2$. Applying an amount of the composition on one side of the paper.

In one or more embodiments, the method includes preparing a first composition of a cannabinoid and applying same onto the paper product and preparing a second composition that includes terpenes and/or terpenoids and applying same following the application of the first composition.

Optionally, the first and/or second compositions include an antioxidant. Optionally, the first composition includes a fixative agent other than cannabinoid. Spreading the composition, optionally with a cotton pad or using one or more rollers. Alternatively, or additionally the paper product may be immersed within a bath containing the terpene and/or terpenoid composition. Optionally, an excess amount of the composition is being removed.

Optionally, applying an amount of the composition on the other side of the paper, and spreading the composition, optionally using one or more rollers. Optionally, inserting the composition by physical means, such as by applying pressure, to thereby press and insert the compounds within the composition into the pores and fibers of the paper.

In an embodiment of the invention, the pressure is between about 100 g/sq inch and about 5000 g/sq inch. For example, between about 100 g/sq inch and about 4000 g/sq inch, between about 100 g/sq inch and about 3000 g/sq inch, between about 100 g/sq inch and about 2000 g/sq, between about 100 g/sq inch and about 1000 g/sq inch, between about 100 g/sq inch and about 500 g/sq inch, between about 400 g/sq inch and about 5000 g/sq inch, between about 800 g/sq inch and about 5000 g/sq inch, between about 1000 g/sq inch and about 5000 g/sq, between about 2000 g/sq inch and about 5000 g/sq inch, between about 3000 g/sq inch and about 5000 g/sq inch, or between about 4000 g/sq inch and about 5000 g/sq, or any value in between.

In an embodiment of the invention, the pressure is between about 16 g/cm$^2$ and about 775 g/cm$^2$. For example, between about 16 g/cm$^2$ and about 620 g/cm$^2$, between about 16 g/cm$^2$ and about 465 g/cm$^2$, between about 16 g/cm$^2$ and about 310 g/cm$^2$, between about 16 g/cm$^2$ and about 155 g/cm$^2$, between about 16 g/cm$^2$ and about 775 g/cm$^2$, between about 62 g/cm$^2$ and about 775 g/cm$^2$, between about 124 g/cm$^2$ and about 775 g/cm$^2$, between about 155 g/cm$^2$ and about 775 g/cm$^2$, between about 310 g/cm$^2$ and about 775 g/cm$^2$, between about 465 g/cm$^2$ and about 775 g/cm$^2$, or between about 620 g/cm$^2$ and about 775 g/cm$^2$, or any value in between.

For example, pressure may be applied for each side of the paper or for both sides concomitantly at least one time, at least two times, at least three times, or at least four times.

The method may optionally include cutting the paper to any desired dimensions and packing the paper with the aroma and flavor compounds inserted therein the paper.

In one or more embodiments, the method further comprises a step of sealing the package.

In one or more embodiments, the paper is inserted within the package immediately thereafter the paper is prepared.

Optionally, the paper is being coated (e.g., by spraying) with cellulose to seal the surface. Additional pressure may optionally be applied also following the cellulose coating.

The method may optionally include a step of incubating the paper product with the composition for at least about 10 minutes.

Reference to the term "about" has its usual meaning in context to the herein invention of a reasonable variation from a stated amount that retains the ability to achieve one or more functional effect to substantially the same extent as the stated amount. The term may also refer herein to a value of plus or minus 15% of the stated value; plus or minus 10% of the stated value; or plus or minus 5%, or plus or minus 1%, or plus or minus 0.5%, or plus or minus 0.1%, or any percentage in between. For example, "about 20" may mean or include amounts from 18 up to and including 22, to the extent those amounts achieve one or more functional effect to substantially the same extent as an amount of 20 would.

As used herein, a molecule is said to be a "chemical derivative" of another molecule when it contains additional chemical moieties not normally a part of the molecule. Such moieties can improve the molecule's solubility, absorption, biological half-life, and the like. The moieties can alternatively decrease the toxicity of the molecule, eliminate or attenuate any undesirable side effect of the molecule, and the like. Moieties capable of mediating such effects are disclosed in Remington's Pharmaceutical Sciences (1980). Procedures for coupling such moieties to a molecule are well known in the art. The term "chemical derivative" includes a functional activity of a molecule that possesses an activity that is substantially similar to a chemical activity of the molecule stated.

EXAMPLES

The invention will be described in greater detail by way of specific examples. The following examples are offered for illustrative purposes, and to exemplify the compositions and methods described herein and are not intended to limit the invention in any manner. Many variations will suggest themselves and are within the full intended scope. Those of skill in the art will readily recognize a variety of non-critical parameters which can be changed or modified to yield essentially the same results.

Example 1

In order to maintain the fragrance in the paper, the fixative agent should dissolve the highly hydrophobic terpene mixture and, at the same time, possess a good adhesion to the hydrophilic cellulose fibers of the paper. Potential fixatives were evaluated using the Hansen Solubility Parameters (HSP; Hansen solubility parameters: a user's handbook. 2nd ed., edited by Charles Hansen, CRC Press, 2007, ISBN 0-8493-7248-8). HSP affords for a good estimate of: i) Van der Waals forces between the molecules (i.e., δD); ii) attraction due to polar interactions (i.e., δP); and iii) forces due to hydrogen bonds (i.e., δH). The HSP values of cellulose, some fixatives, and exemplary cannabis fragrance terpenes are presented at Table 1. The table shows that cellulose has very high δP and δH values, compared to terpenes. A good fixative is expected to possess δP and δH below 19.9 and 22.5, respectively in order to avoid from dissolving the main paper product cellulose. A good fixative is further expected to possess δP and δH above the δP and δH of terpenes and terpenoids in order to allow dissolving the terpenes and terpenoids.

TABLE 1

Hansen Solubility Parameters (HSP) of cellulose, fixatives, and major cannabis fragrance terpenes.

| | δD (MPa½) | δP (MPa½) | δH (MPa½) |
|---|---|---|---|
| Amorphous cellulose | 24.3 | 19.9 | 22.5 |
| Fixatives | | | |
| 1,3-Butanediol | 16.6 | 10.0 | 21.5 |
| Dipropylene Glycol M.W. 134 | 16.5 | 10.6 | 17.7 |
| PPG-20 Methyl Glucose Ether M.W. ~1300* | — | — | — |
| Polypropylene glycol M.W. ~3000 | 15.0 | 6.9 | 7.2 |
| Triethyl Citrate | 16.5 | 4.9 | 12.0 |
| Terpenes/terpenoids | | | |
| Caryophyllene | 16.8 | 0.7 | 2.2 |
| Limonene | 17.2 | 1.8 | 4.3 |
| Linalool | 16.7 | 2.8 | 6.7 |
| Myrcene | 16.0 | 1.6 | 2.2 |
| Pinene | 17.4 | 3.0 | 3.2 |

*The HSP of PPG-20 Methyl Glucose Ether are unknown but they are expected to be between the HSP of the shortest and most polar polypropylene glycol, dipropylene glycol, and the HSP of high molecular weight polypropylene glycols that are less polar.

Example 2

Aim:

Determination of the aroma stability of: i) pure terpene profile and ii) a mixture of a pure terpene profile in combination with a fixative agent, and an antioxidant agent.

Method:

Three sets of rolling papers (2 consisting of 6 papers each and 1 of 2 papers) were weighed before and after applying the terpene mixtures thereon. The papers were then individually closed and incubated in centrifuged tubes for 1 hour. The weight of each paper was thereafter measured at time 0 (immediately after taking it out of the tube), 3, 10, 20, 40, 60 and 90 minutes while staying in an opened environment.

1. The first set of 6 papers—pure terpene profile (28 μl) was applied on both sides of the paper (14 μl on each side) by an 8-channel pipette, and the liquid was distributed by a roller.
2. The set of 2 papers—pure terpene profile (14 μl) was applied on only one side of the paper by an 8-channel pipette, and the liquid was distributed by a roller.
3. The second set of 6 papers—a mixture of pure terpene profile and a fixative agent, and antioxidative agent was applied on both sides of the paper (14 μl on each side) by an 8-channel pipette, and the liquid was distributed by a roller.

Results:

As can be seen in FIG. 1, a combination of a mixture of pure terpene profile, a fixative agent, and an antioxidative agent (striped line) achieves a stable product, wherein the terpene composition is significantly maintained within the paper even following 90 minutes. A composition comprising terpenes only in a similar amount (dotted line) was significantly less stable. A composition comprising terpenes in lowest amount presented steeper evaporation of the terpenes (a full line). The increase in weigh % show in all cases following 60 minutes is due to a certain level of water adsorption.

Example 3

Paper samples were infused with a terpene and/or terpenoid composition (hereinafter "composition 1") and with a comparable composition that further comprises a fixative agent, i.e., PPG-20 Methyl Glucose Ether (i.e., Glucam P-20) at an amount of about 50% by weigh and an antioxidant, i.e., vitamin E at an amount of 0.95% by weight acetate (hereinafter "composition 2").

Paper samples were maintained in closed chamber until evaluation. The samples were then dissolved in chloroform to obtain solutions with total terpenes and terpenoids concentration of 125 mg/ml. A volume of 26.7 μl (contains 3.34 mg of the sample) was injected into a GC/MS. The GC/MS equipment is Agilent Technologies, consisting of GC System 7890A, injector with autosampler 7683B Series, and EI/CI MSD with Triple-Axis Detector 5975C. Gas: Helium 5.0; pressure 6.9972 psi. Column: HP-5MS 5% Phenyl Methyl Silox, temperature limit from −60° C. to 325° C.; length: 30 m, diameter: 0.25 mm, film: 0.25 μm. Temperature program: 40° C. for 3 min, then 5° C./min to 300° C. for 5 min. Run time: 60 minutes. Split Ratio: 15:1. Split Flow: 29.9 ml/min. MS source: 230° C., max 250° C.; MS Quad.: 150° C., max 200° C.

Table 2 presents the percentage of each particular terpene/terpenoid compound, in each sample tested relative to the total terpene and terpenoid content as measured at unexposed (to air) conditions.

TABLE 2 percentage of each terpene compound and Vitamin E in the tested paper samples

| Peak | R.T. [min] | Compound | % of total Composition 1 | % of total Composition 2 |
|---|---|---|---|---|
| 1 | 9.52 | α-Pinene | 0.78 | 0.68 |
| 2 | 10.05 | Camphene | 0.08 | n.d. |
| 3 | 10.83 | Sabinene | 0.08 | n.d. |
| 4 | 10.98 | β-Pinene | 0.91 | 0.80 |
| 5 | 11.41 | β-Myrcene | 1.10 | 0.97 |
| 6 | 12.28 | α-Terpinene | 1.13 | 0.95 |
| 7 | 12.62 | p-Cymene | 0.73 | 2.14 |
| 8 | 12.73 | Limonene + eucalyptol | 5.25 | 4.12 |
| 9 | 13.03 | cis-Ocimene | 9.40 | 10.73 |
| 10 | 13.08 | trans-Ocimene | 2.68 | n.d. |
| 11 | 13.90 | γ-Terpinene | 34.67 | 35.21 |
| 12 | 14.82 | Terpinolene | 34.62 | 36.68 |
| 13 | 14.89 | Dehydro-p-cymene | 1.12 | tr. |
| 14 | 15.01 | β-Linalool | 0.12 | 0.08 |
| 15 | 15.64 | Fenchol, exo- | 0.52 | 0.46 |
| 16 | 16.95 | Isoborneol | 0.08 | n.d. |
| 17 | 17.21 | Borneol | 0.07 | n.d. |
| 18 | 17.33 | trans-2-Caren-4-ol | 0.11 | 0.05 |
| 19 | 17.68 | p-Cymen-8-ol | 0.06 | n.d. |
| 20 | 17.89 | p-Menth-1-en-8-ol | 0.25 | 0.22 |

TABLE 2-continued percentage of each terpene compound and Vitamin E in the tested paper samples

| Peak | R.T. [min] | Compound | % of total Composition 1 | % of total Composition 2 |
|---|---|---|---|---|
| 21 | 20.36 | Bornyl acetate | 0.05 | n.d. |
| 22 | 24.06 | β-Caryophyllene | 2.54 | 2.22 |
| 23 | 24.76 | Humulen | 0.08 | n.d. |
| 24 | 24.94 | α-Caryophyllene | 0.87 | 0.04 |
| 25 | 25.83 | Eremophylene | 0.08 | tr. |
| 26 | 28.01 | Caryophyllene oxide | 0.09 | 0.05 |
| 27 | 54.73 | Vitamin E acetate | tr. | 2.90 |

*n.d. designates: not detected; tr. designates: trace amount (below 0.01% of the total).

Table 2 shows the terpenes and terpenoids profile in composition 1 and composition 2, in unexposed (to air) conditions. The terpene/terpenoid profile in each of the 1 and 2 compositions was also evaluated at time points 0, 10, 20, and 30 min after unpacking the samples.

TABLE 3 percentage of each particular terpene/terpenoid compound, in composition 1 relative to the total soluble compounds in the final product at various time points (stability of raw material over time).

| Peak | R.T. [min] | Compound | % of composition 1 0 min | 10 min | 20 min | 30 min |
|---|---|---|---|---|---|---|
| 1 | 13.68 | γ-Terpinene | Tr. | 5.15 | 2.70 | 6.10 |
| 2 | 14.54 | Terpinolene | 12.04 | Tr. | 3.32 | 9.18 |
| 3 | 14.69 | Dehydro-p-cymene | Tr. | Tr. | Tr. | 0.85 |
| 4 | 15.01 | β-Linalool | Tr. | Tr. | Tr. | 1.01 |
| 5 | 15.64 | exo-Fenchol | Tr. | Tr. | 1.76 | 4.09 |
| 6 | 16.97 | Borneol | Tr. | Tr. | Tr. | 0.72 |
| 7 | 17.35 | trans-2-Caren-4-ol | Tr. | Tr. | 1.64 | 2.48 |
| 8 | 17.70 | p-Cymene-8-ol | Tr. | Tr. | 1.91 | 2.03 |
| 9 | 17.91 | p-Menth-1-en-8-ol | Tr. | Tr. | 1.76 | 2.89 |
| 10 | 24.03 | β-Caryophyllene | 10.71 | 5.48 | 2.20 | 4.36 |
| 11 | 24.93 | α-Caryophyllene | Tr. | 2.10 | 0.85 | 1.81 |
| 12 | 54.70 | Vitamin E acetate | Tr. | 3.20 | 10.35 | 1.84 |

Figure 2:
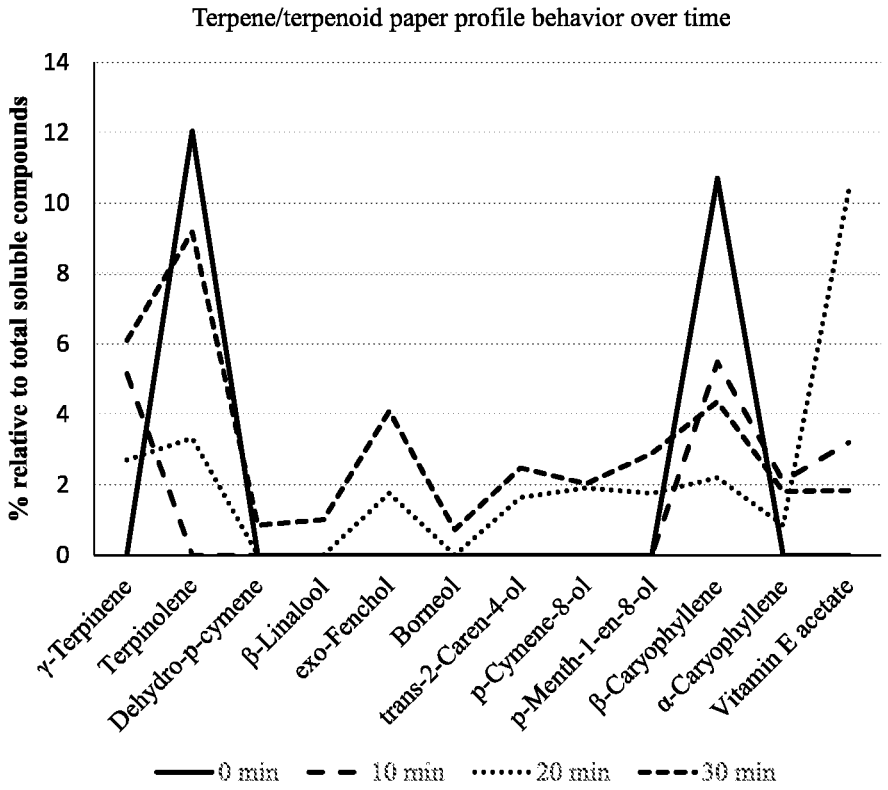
FIG. 2 is a line graph showing relative amounts of terpenes and terpenoids in a paper product comprising a terpene/terpenoid composition; according to some embodiments of the invention.

FIG. 2 and the above table 3 present % of each terpenoid present in paper products that were incorporated with composition 1 at various time intervals after opening the packages.

The data shows that terpene/terpenoid profile at time point 0 is completely different then the terpene/terpenoid profile at the other time points tested. Namely, the profile of the terpene and terpenoid molecules changes over time. That is due to the fact that certain terpenes/terpenoids may evaporate faster than other terpenes/terpenoids. Consequently, the ratio between the terpenes/terpenoids changes hence the terpenes/terpenoids molecular profile. The terpene/terpenoid profile has a significant effect on taste. When the ratio of the terpene/terpenoid compound changes, the overall flavor and aroma changes.

TABLE 4 percentage of particular terpene/terpenoid compound, in composition 2 relative to the total soluble compounds content in sample at various time points.

| Peak | R.T. [min] | Compound | % of composition 2 0 min | 10 min | 20 min | 30 min |
|---|---|---|---|---|---|---|
| 1 | 12.62 | p-Cymene | 0.39 | 0.28 | Tr. | 0.76 |
| 2 | 12.97 | β-trans-Ocymene | 1.24 | 0.90 | 0.58 | 1.27 |
| 3 | 13.68 | γ-Terpinene | 10.78 | 7.91 | 5.21 | 10.18 |

TABLE 4-continued percentage of particular terpene/terpenoid compound, in composition 2 relative to the total soluble compounds content in sample at various time points.

| Peak | R.T. [min] | Compound | % of composition 2 0 min | 10 min | 20 min | 30 min |
|---|---|---|---|---|---|---|
| 4 | 14.54 | Terpinolene | 17.01 | 11.90 | 7.83 | 15.26 |
| 5 | 14.69 | Dehydro-p-cymene | 1.80 | 1.26 | 0.70 | 1.36 |
| 6 | 15.01 | β-Linalool | 1.27 | 0.83 | 0.57 | 0.68 |
| 7 | 15.64 | exo-Fenchol | 4.66 | 3.20 | 2.40 | 3.32 |
| 8 | 16.97 | Iso-Borneol | 1.06 | 0.65 | Tr. | 0.38 |
| 9 | 17.24 | Borneol | n.d. | 0.71 | 0.48 | 0.45 |
| 10 | 17.35 | trans-2-Caren-4-ol | 1.39 | 1.08 | 0.82 | 1.44 |
| 11 | 17.70 | p-Cymene-8-ol | 1.50 | 1.25 | 1.05 | 1.18 |
| 12 | 17.91 | p-Menth-1-en-8-ol | 3.47 | 2.50 | 1.64 | 1.69 |
| 13 | 18.03 | γ-Terpineol | 0.43 | 0.31 | Tr. | 0.21 |
| 14 | 24.03 | β-Caryophyllene | 8.81 | 5.36 | 3.31 | 4.01 |
| 15 | 24.93 | α-Caryophyllene | 3.68 | 2.28 | 1.40 | 1.62 |
| 16 | 25.83 | Eremophylene | 0.46 | 0.33 | Tr. | 0.34 |
| 17 | 28.01 | Caryophylene oxide | 0.92 | 0.67 | 0.50 | 0.48 |
| 18 | 54.70 | Vitamin E acetate | 5.59 | 4.93 | 5.18 | 3.07 |

Figure 3:
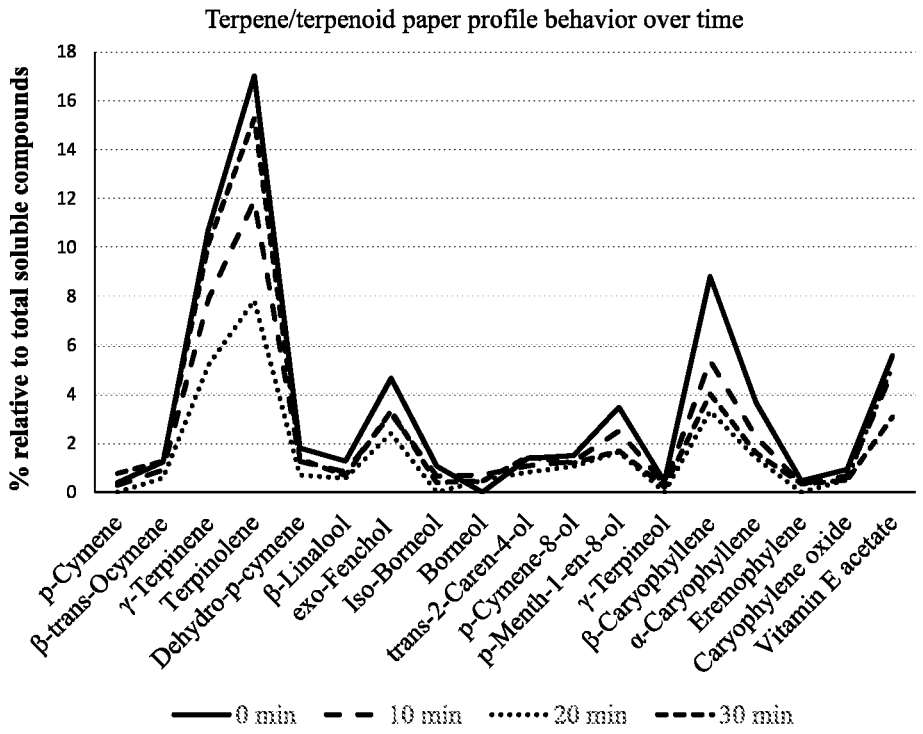
FIG. 3 is a line graph showing relative amounts of terpenes and terpenoids in a paper product comprising terpene/terpenoid composition that comprises a fixative agent and an antioxidant agent; according to some embodiments of the invention.

FIG. 3 and the above table 4 present the % of each terpenoid present in paper products that were incorporated with composition 2 at various time points after opening the packages. The data shows that terpene/terpenoid profile (i.e., molecule type and/or ratio of the compounds within the composition) is stably maintained at all time points tested following exposure to ambient environment. Consequently, the overall flavor and aroma should be maintained over time.

Example 4

Application on the papers of CBD (100 mg), dissolved in 100 μl diethyl ether, which after the solvent evaporation gave papers infused with CBD (45 mg) and it was followed by the infusion of pure terpenoids (45 mg).

Thus, the final weight ratio between CBD and the terpenoids was 1:1. The mixture (mg) retained on the papers during 10 min interval in open environment is presented in FIG. 4. The terpene weight (mg) remaining on the papers during the 10 minutes period in open environment is presented in FIG. 5.

Figure 4:
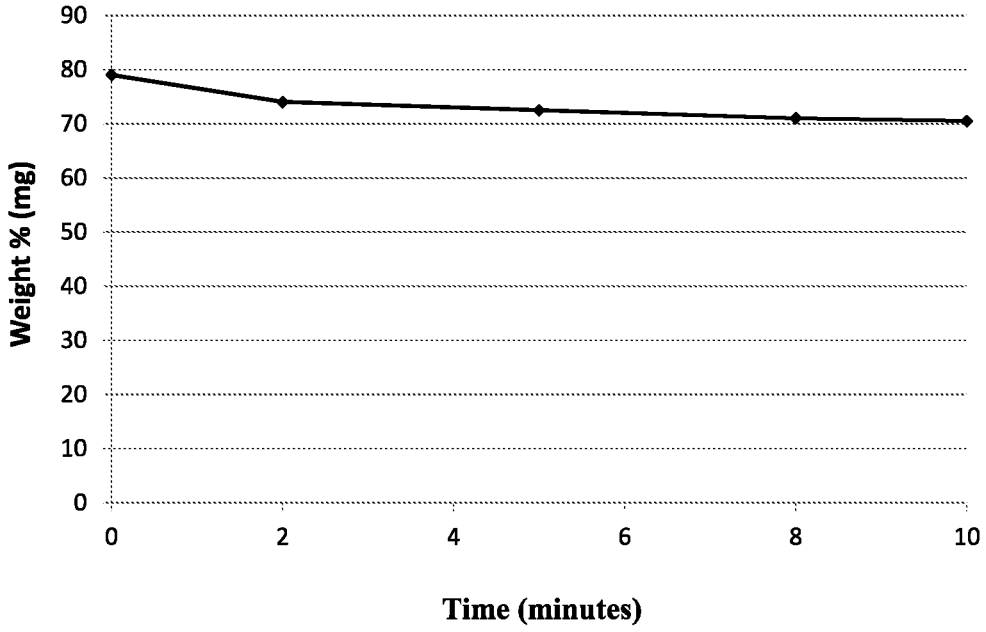
FIG. 4 is a line graph showing retention of a mixture containing CBD and terpenoids in initial ratio 1:1 during 10 min period at ambient conditions, according to some embodiments of the invention.
Figure 5:
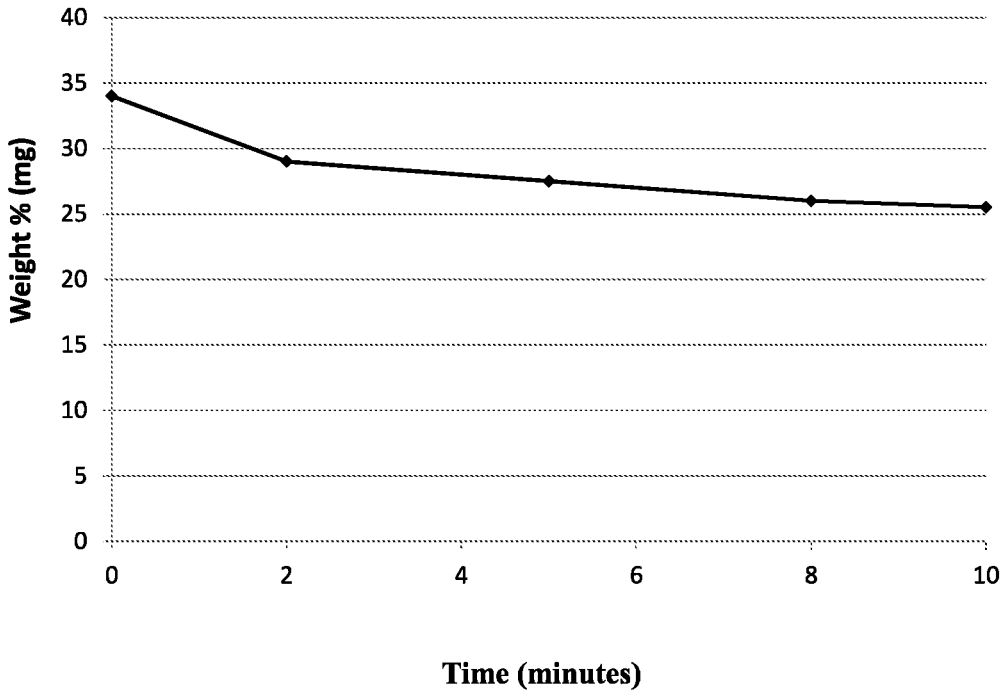
FIG. 5 is a line graph showing the weight of the terpenoids (mg) retained on papers during 10 minutes period at ambient conditions following application of a mixture containing CBD and terpenoids in a ratio of 1:1, according to some embodiments of the invention.

As can be seen in FIG. 4, the overall terpenoids and cannabinoids maintained in the paper product following 10 minutes exposure to the environment is above about 75%. As it can be further seen in FIG. 5, more than 55% of the terpenoids maintained in the papers following 5 minutes and even 10 minutes exposure to the environment.

Example 5

Figure 6:
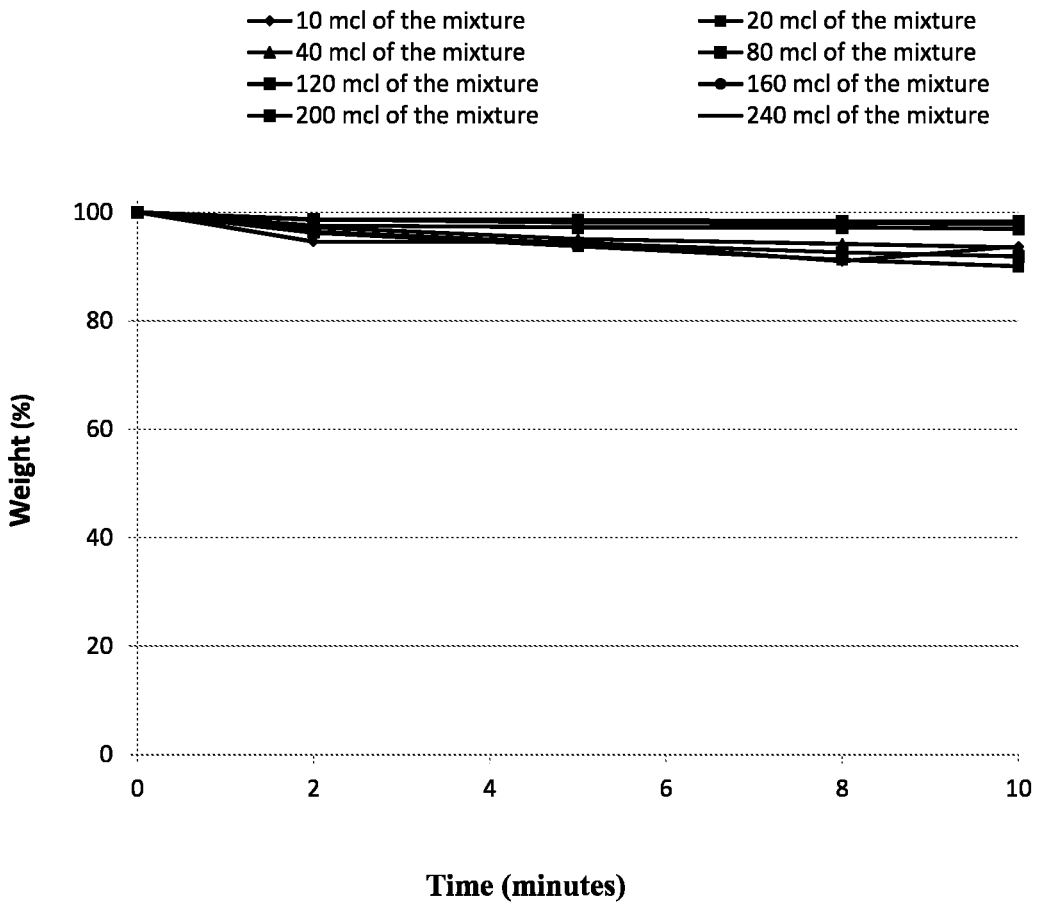
FIG. 6 is a line graph showing retention (weight %) of various amounts (μl) of a mixture of CBD and terpenoids provided with an initial ratio of 1:1 during 10 min period at ambient conditions, according to some embodiments of the invention.

Application of various amounts (10 to 240 μl) of a mixture containing CBD and terpenoids in ratio 1:1 (Tables 5 and 6, FIG. 6). As can be seen from FIG. 6 application of a mixture of CBD and terpenoids in ratio 1:1 ensures more than 90% retention in the paper of the overall mixture and in particular of the terpenoids, resp.

TABLE 5 retention of various amounts of a mixture of CBD and terpenoids (1:1) during 10 minutes at ambient temperature.

| Amount of the applied mixture (μl) | Weight of the mixture retained on the papers during 10 minutes period in open air (mg) 0' | 2' | 5' | 8' | 10' |
|---|---|---|---|---|---|
| 10 | 11.1 | 10.5 | 10.5 | 10.1 | 10.4 |
| 20 | 16.0 | 15.4 | 15.0 | 14.6 | 14.4 |
| 40 | 32.4 | 31.5 | 30.8 | 30.5 | 30.3 |
| 80 | 52.8 | 50.9 | 49.8 | 48.9 | 48.5 |
| 120 | 70.1 | 68.4 | 68.1 | 68.1 | 67.9 |
| 160 | 112.1 | 110.6 | 110 | 109.9 | 109.8 |
| 200 | 134.6 | 132.9 | 132.7 | 132.5 | 132.5 |
| 240 | 184.8 | 182.2 | 181.9 | 181.8 | 181.9 |

TABLE 6

Weight (%) of the mixture of CBD and terpenoids in ratio 1:1, retained on papers infused with various amounts (μl) of the mixture during 10 minutes period at ambient conditions.

| Amount of the applied mixture (μl) | Weight of the mixture retained on the papers during 10 minutes period in open air, % 0' | 2' | 5' | 8' | 10' |
|---|---|---|---|---|---|
| 10 | 100 | 94.6 | 94.6 | 91.0 | 93.7 |
| 20 | 100 | 96.3 | 93.8 | 91.3 | 90.0 |
| 40 | 100 | 97.2 | 95.1 | 94.1 | 93.5 |
| 80 | 100 | 96.4 | 94.3 | 92.6 | 91.9 |
| 120 | 100 | 97.6 | 97.2 | 97.2 | 96.9 |
| 160 | 100 | 98.7 | 98.1 | 98.0 | 97.9 |
| 200 | 100 | 98.7 | 98.6 | 98.4 | 98.4 |
| 240 | 100 | 98.6 | 98.4 | 98.4 | 98.4 |

Example 6

The following are exemplary compositions of terpenes and/or terpenoids, an antioxidant (vitamin E acetate) and a fixative agent (Glucam P-20).

Formulation #1—The formulation composition includes 49.5% terpene profile (17% γ-terpinene, 17% terpinolene, 5% β-cis-ocimene, 1% D-limonene, 1%3-trans-caryophyllene, 1% 1,8-cineole, 1% β-trans-ocimene), 49.5% Glucam P-20, and 1.0% vitamin E acetate.

Formulation #2—The formulation composition includes 49.5% terpene profile (20% β-trans-caryophyllene, 10% humulene, 9% D-limonene, 5% linalool), 49.5% Glucam P-20, and 1.0% vitamin E acetate.

Formulation #3—The formulation composition includes 49.5% terpene profile (20% terpinolene, 7.0% β-trans-caryophyllene, 5% D-limonene, 5% β-trans-ocimene, 3% myrcene, 2% β-pinene, 1% γ-terpinene, 1% α-pinene), 49.5% Glucam P-20, and 1.0% vitamin E acetate.

Example 7

The following are exemplary compositions of terpenes and/or terpenoids, and a cannabidiol.

Formulation #4—The formulation composition includes 50.0% terpene profile (18% γ-terpinene, 18% terpinolene, 5% β-cis-ocimene, 2% D-limonene, 2% β-trans-ocimene, 2% β-trans-caryophyllene, 1% 1,8-cineole) and 50.0% CBD.

Formulation #5—The formulation composition includes 78.3% terpene profile (31% β-trans-caryophyllene, 15% humulene, 14% D-limonene, 8% linalool, 1% caryophyllene oxide, 1% β-pinene, 1% α-terpineol) and 21.7% CBD.

Example 8

The following is an exemplary composition of terpenes and/or terpenoids, and a combination of cannabidiol and PEG-400 as fixatives.

Formulation #6—The formulation composition includes 26.4% terpene profile (11% terpinolene, 4% β-trans-caryophyllene, 2% D-limonene, 2% β-trans-ocimene, 1% myrcene, 1% β-pinene), 7.0% CBD, and 66.0% PEG-400.

Example 9

The following table 7 illustrates the Hansen Solubility Parameters (HSP) of cellulose, fixatives, selected cannabinoids, and major cannabis fragrance terpenes.

TABLE 7 the Hansen Solubility Parameters (HSP) of cellulose, fixatives, selected cannabinoids, and major cannabis fragrance terpenes

| Substance | δD ($MPa^{1/2}$) | δP ($MPa^{1/2}$) | δH ($MPa^{1/2}$) |
|---|---|---|---|
| Amorphous cellulose | 24.3 | 19.9 | 22.5 |
| Fixatives | | | |
| Dipropylene glycol, Mw 134 | 16.5 | 10.6 | 17.7 |
| Polypropylene glycol, Mw ~3000 | 15.0 | 6.9 | 7.2 |
| Triethyl citrate | 16.5 | 4.9 | 12.0 |
| Cannabinoids* | | | |
| CBGV | 18.0 | 2.6 | 7.5 |
| CBDV | 17.8 | 2.2 | 7.3 |
| CBE | 17.9 | 3.2 | 6.7 |
| CBG | 17.8 | 2.5 | 6.4 |
| CBD | 17.7 | 2.1 | 6.3 |
| CBCV | 18.0 | 2.3 | 5.9 |
| CBV | 18.6 | 2.2 | 5.9 |
| THCV | 17.6 | 1.7 | 5.8 |
| CBC | 17.8 | 2.2 | 5.4 |
| CBN | 18.4 | 2.1 | 5.4 |
| CBL | 17.6 | 1.8 | 4.4 |
| Cannabinoid acids | | | |
| CBGVA | 18.5 | 3.2 | 9.8 |
| CBDVA | 18.4 | 2.5 | 9.4 |
| CBCVA | 18.5 | 2.6 | 8.3 |
| THCVA | 18.1 | 2.3 | 8.4 |
| CBGA | 18.3 | 3.0 | 7.8 |
| CBDA | 18.2 | 2.4 | 7.5 |
| CBCA | 18.3 | 2.4 | 7.4 |
| CBLA | 18.1 | 2.5 | 6.8 |
| Terpenes/terpenoids | | | |
| Linalool | 16.8 | 2.9 | 6.9 |
| Terpinolene | 17.2 | 1.9 | 4.1 |
| Humulene | 17.0 | 1.6 | 3.9 |
| γ-Terpinene | 16.6 | 1.7 | 3.7 |
| D-Limonene | 16.7 | 1.9 | 3.2 |
| α-Pinene | 16.9 | 1.8 | 3.1 |
| Myrcene | 16.1 | 1.9 | 2.8 |
| β-Caryophyllene | 16.8 | 0.7 | 2.2 |

*The solubility parameters of cannabinoids and terpene(s)/terpenoid(s) were calculated using the Hansen HSPiP software.

Example 10

Figure 7:
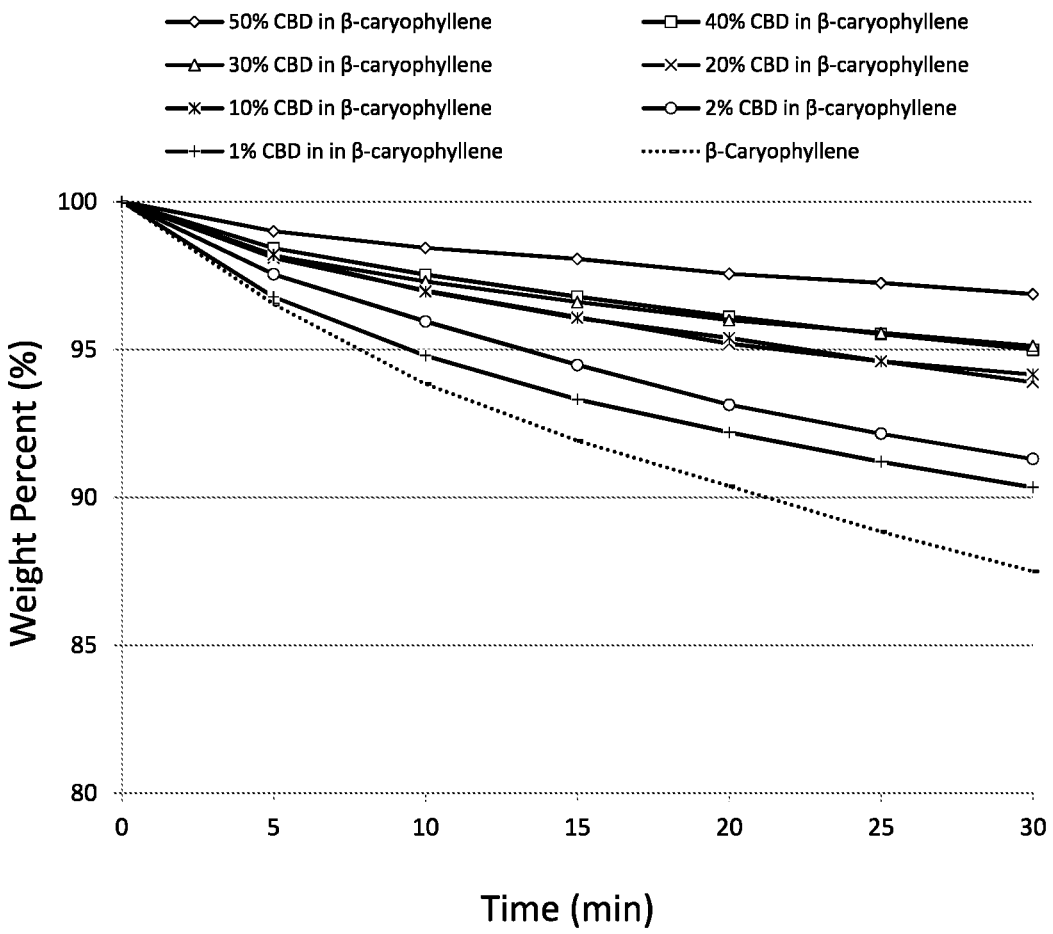
FIG. 7 is a line graph illustrating retention (weight %) of β-caryophyllene on rolling papers in the presence of CBD for 30 minutes, according to some embodiments of the invention.

A mixture of CBD and β-caryophyllene (flash point 96° C., Sigma-Aldrich) were incorporated onto a paper product. As can be seen in FIG. 7, CBD improves the terpene retention on the paper at ambient conditions in a dose dependent manner. CBD mostly improves the retention when provided in an amount of 50% by weight (β-caryophyllene: CBD 1:1). The minimal quantity of CBD that improves the retention of β-caryophyllene is about 1% (β-caryophyllene: CBD in a ratio of 100:1 or β-caryophyllene: CBD in a ratio of 1:0.01).

Example 11

Figure 8:
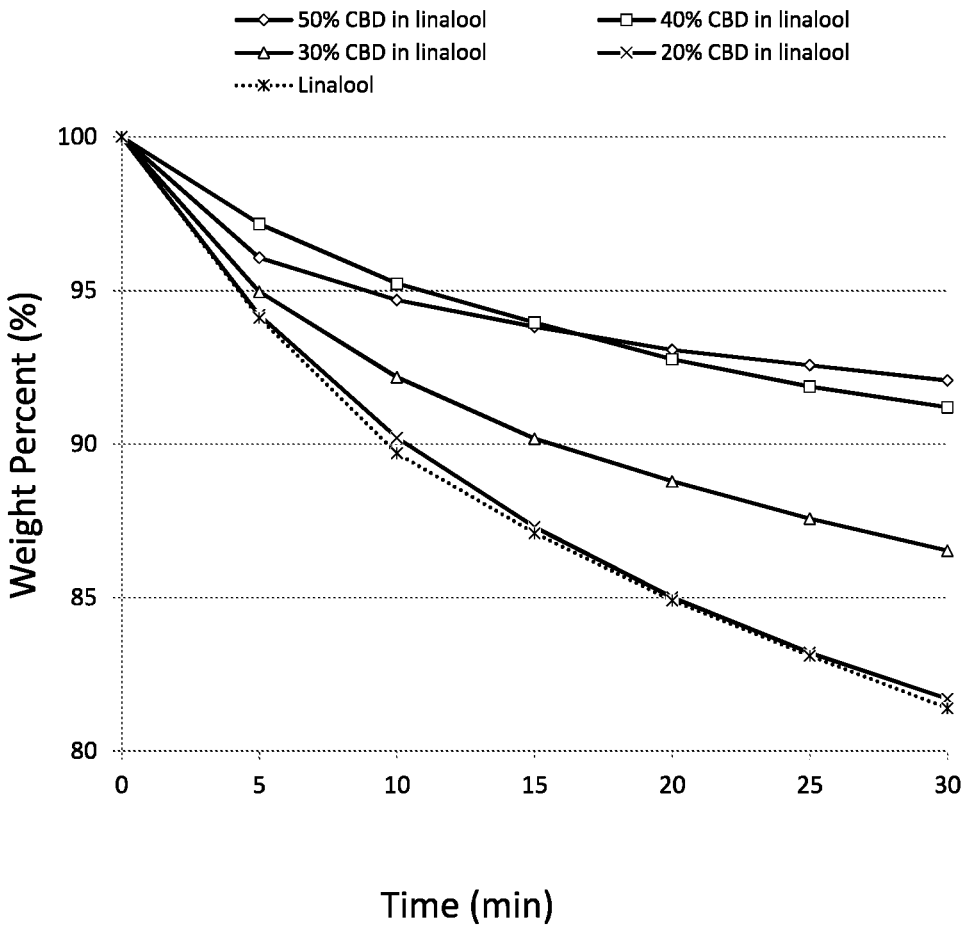
FIG. 8 is a line graph illustrating retention (weight %) of linalool on rolling papers in presence of CBD for 30 minutes, according to some embodiments of the invention.

A mixture of CBD and a relatively unstable terpenoid, such as linalool (flash point 78° C., Sigma-Aldrich) were incorporated onto a paper product. As can be seen in FIG. 8, 50% CBD by weight (linalool: CBD 1:1) improves significantly the linalool retention on the paper at ambient conditions for the first 15 minutes after the infusion. The minimal amount of CBD able to fixate linalool is about 20% (linalool: CBD in a ratio of 4:1 or linalool: CBD 1:0.25).

Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

The invention claimed is:

1. An aromatized and/or flavored paper product, the paper product comprising:

cellulose; at least one terpene and/or at least one terpenoid;

at least one of a fixative agent, wherein the fixative agent is characterized by binding capacity to the cellulose of the paper product, and binding capacity to the terpene and/or terpenoid; and at least one of an antioxidant;

wherein the paper product is porous presenting pores having a diameter of about $1\times10^{-3}$ μm to about $2\times10^{-3}$ μm, and wherein the terpene and/or terpenoid is maintained in the paper product for a substantially longer time as compared to a corresponding paper product having a similar terpene and/or terpenoid composition without a fixative agent and/or an antioxidant.

2. The paper product of claim 1, wherein the antioxidant is selected from the group consisting of: butylated hydroxyanisole, butylated hydroxytoluene, cannabidiol, propyl gallate, tertiary butylhydroquinone, tocopherol, a carotenoid, a phenol, a vitamin, vitamin E acetate, and any combination thereof.

3. The paper product of claim 1, wherein the fixative agent is characterized by at least one of: non-toxicity, flavorless, odorless, having a vapor pressure less than 0.1 mm Hg at 20° C., having Hansen parameters of δP and δH with values below the δP and δH values of cellulose, having Hansen parameters of δP and δH with values above the δP and δH values of terpenes and terpenoids applied onto the paper product, or any combination thereof.

4. The paper product of claim 3, wherein the fixative agent is having Hansen parameters of δP value below about 19.9 MPa½ and δH value below about 22.5 MPa½.

5. The paper product of claim 1, wherein the fixative agent is selected from the group consisting of: a cannabinoid, triethyl citrate, polypropylene glycol having a M.W. of about 160 Da to about 10,000 Da, polypropylene glycol having a M.W. of about 160 Da to about 400, polypropylene glycol having a M.W. of about 4,000 to about 10,000 Da, a branched polypropylene glycol, a PPG-20 methyl glucose ether, polyethylene glycol, PEG-400, and any combination thereof.

6. The paper product of claim 5, wherein the fixative agent is a cannabinoid.

7. The paper product of claim 6, wherein the cannabinoid is selected from a group consisting of: cannabidiol (CBD), tetrahydrocannabinol (THC), Δ9-tetrahydrocannabinolic acid (THCA), cannabigerovarin (CBGV), cannabidivarin (CBDV), cannabielsoin (CBE), cannabigerol (CBG), cannabidiol (CBD), cannabichromevarin (CBCV), cannabivarin (CBV), tetrahydrocannabivarin (THCV), cannabichromene (CBC), cannabinol (CBN), cannabicyclol (CBL), cannabigerovarinic acid (CBGVA), cannabidivarinic acid (CBDVA), tetrahydrocanabivarinic acid (THCVA), cannabigerolic acid (CBGA), cannabidiolic acid (CBDA), cannabichromenenic acid (CBCA), cannabicyclolic acid (CBLA), and any combination thereof.

8. The paper product of claim 1, wherein the terpene and/or the terpenoid is provided as a natural cannabis plant extract, an isolated terpene and/or the terpenoid, a synthetic compound, and a combination thereof.

9. The paper product of claim 1, wherein the paper product is a smoking paper product selected from a rolling paper, a tip and a filter.

10. The paper product claim 1, wherein said paper product is manufactured by applying onto said paper a composition comprising said at least one terpene(s) and/or at least one terpenoid(s), said at least one of a fixative agent and said at least one of an antioxidant.

11. The paper product of claim 10, wherein said at least one terpene(s) and/or at least one terpenoid(s) is in an amount of at least about 20% by weight of the composition;

said at least one of an antioxidant is in an amount of about 0.1% to about 3% by weight of the composition; and said at least one of a fixative agent is in an amount of at least about 20% by weight of the composition.

12. The paper product of claim 10, wherein said at least one terpene(s) and/or at least one terpenoid(s) is in an amount of at least about 20% by weight of the composition; and the composition comprises one or more of a cannabinoid in an amount of at least about 20% by weight of the composition.

13. The paper product of claim 10, wherein said at least one terpene(s) and/or at least one terpenoid(s) is in an amount of at least about 20% by weight of the composition;

the composition comprises one or more of a cannabinoid in an amount of at least about 5% by weight of the composition; and the composition comprises at least one of a fixative agent other than a cannabinoid in an amount of at least about 20% by weight of the composition.

14. The paper product of claim 10, wherein the weight ratio between the terpenes and/or terpenoids and the fixative agent is between 4:1 to 1:4.

15. The paper product of claim 14, wherein the ratio between the fixative agent and the terpene and/or terpenoid in said composition is about 1:1 to about 3:1.

16. The paper product of claim 10, being manufactured by applying pressure onto said paper following, or concomitantly to applying said composition.

17. The paper product of claim 16, wherein said pressure is about 16 g/cm2 to about 775 g/cm2.

18. The paper product of claim 1, comprising a terpene and/or terpenoid profile presenting substantial similarity to the terpene and/or terpenoid profile present naturally within a cannabis strain.

19. The paper product of claim 1, wherein at least about 50% of the terpenes/terpenoids molecules remain in the paper product following 5 minutes exposure to ambient air.

20. An aromatized and/or flavored paper product, the paper product comprising:

cellulose; at least one terpene and/or at least one terpenoid;

at least one of a fixative agent, wherein the fixative agent is characterized by binding capacity to the cellulose of the paper product, and binding capacity to the terpene and/or terpenoid; and at least one of an antioxidant;

wherein the terpene and/or terpenoid present a profile having substantial similarity to the terpene and/or terpenoid profile present naturally within a cannabis plant and wherein the terpene and/or terpenoid is maintained in the paper product for a substantially longer time as compared to a corresponding paper product having a similar terpene and/or terpenoid composition without a fixative agent and/or an antioxidant.

* * * * *